US006804486B2

(12) United States Patent
Lee et al.

(10) Patent No.: US 6,804,486 B2
(45) Date of Patent: Oct. 12, 2004

(54) ACTIVE STEERING SYSTEM AND METHOD THEREOF, AND METHOD OF SEEKING A BALANCE POINT

(75) Inventors: Beom-ro Lee, Gyeonggi-do (KR); Do-soo Lee, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/314,417

(22) Filed: Dec. 9, 2002

(65) Prior Publication Data

US 2003/0129000 A1 Jul. 10, 2003

(30) Foreign Application Priority Data

Dec. 8, 2001 (KR) ..... 2001-77577

(51) Int. Cl.[7] ..... G03G 15/00
(52) U.S. Cl. ..... 399/165
(58) Field of Search ..... 198/806, 807, 198/810.03; 399/165, 116, 162, 312, 313, 329

(56) References Cited

U.S. PATENT DOCUMENTS 5,737,003 A 4/1998 Moe et al. ..... 347/116
5,903,805 A * 5/1999 Ueda et al. ..... 399/165
6,141,526 A * 10/2000 Ikeda ..... 399/165

FOREIGN PATENT DOCUMENTS

JP 10231041 A * 9/1998 ..... G03G/15/00

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

An active steering system and method thereof include a drive source, a steering roller, a steering motor, a steering controller, a belt edge sensor, and a main controller. The steering roller adjusts a belt in a widthwise direction, which is rotated by the drive source. The steering motor drives the steering roller, and the steering controller controls the steering motor. The belt edge sensor detects a belt edge signal according to a position of the belt in the widthwise direction. The main controller controls the drive source and/or the steering controller where the belt is rotated based on a balance point at which an amount of change of at least one value of the belt edge signal and a step number of the steering motor is less than or equal to a predetermined value.

41 Claims, 15 Drawing Sheets

ACTIVE STEERING SYSTEM AND METHOD THEREOF, AND METHOD OF SEEKING A BALANCE POINT

CROSS-REFERENCE TO RELATED APPLICATIONS

This application claims the benefit of Korean Application No. 2001-77577, filed Dec. 8, 2001, in the Korean Intellectual Property Office, the disclosure of which is incorporated herein by reference.

BACKGROUND OF THE INVENTION

1. Field of the Invention

The present invention relates to an active steering system and a method thereof by which a belt can be steered so that additional registration correction is not needed which is used in an image forming apparatus, and a method of seeking a balance point at which the belt is driven most stably.

2. Description of the Related Art

In a system using a belt, a problem of weaving necessarily occurs during the driving of the belt. In particular, in an image forming apparatus of an electrophotography type such as printers, copiers, and facsimiles, weaving of the belt used as a photosensitive medium or transfer medium mainly causes mis-registration so that an image in a main scanning direction is deviated.

When the weaving of the belt used as the photosensitive medium or transfer medium occurs, mis-registration occurs where positions at a starting of the respective lines not being aligned within a page occurs. During formation of a color image, color mis-registration can occur so that color dots are not accurately overlapped. Thus, in the image forming apparatus adopting the belt as the photosensitive medium or transfer medium, a steering technology to control the position of the belt in a main scanning direction (a widthwise direction) is very important to prevent the weaving of the belt.

As shown in FIG. 1, a conventional registration system to control belt steering and scanning start points detects belt edge signals using laser beams emitted from four scanners 5*a*, 5*b*, 5*c*, and 5*d* and uses the belt edge signals, to prevent weaving of the belt and adjusts a deviation of the image due to the weaving of the belt. The four scanners 5*a*, 5*b*, 5*c*, and 5*d* scan the laser beams modulated according to image data onto a photoreceptor belt 1 supported by a plurality of rollers and endlessly circulating, to form an electrostatic latent image.

Referring to FIG. 1, in the conventional registration system, a belt edge sensor 3 includes four photodetectors 3*a*, 3*b*, 3*c*, and 3*d*, which are installed on an edge of the photoreceptor belt 1 to be overlapped. The four photodetectors 3*a*, 3*b*, 3*c*, and 3*d* receive the laser beams scanned by the scanners 5*a*, 5*b*, 5*c*, and 5*d*, respectively, and detect belt edge signals. Because part of the laser beams emitted from the scanners 5*a*, 5*b*, 5*c*, and 5*d* are blocked by the photoreceptor belt 1, the photodetectors 3*a*, 3*b*, 3*c*, and 3*d* receive only remaining portions of the laser beams which are not blocked by the photoreceptor belt 1. Thus, an amount of light received by the photodetectors 3*a*, 3*b*, 3*c*, and 3*d* changes according to a position of the photoreceptor belt 1 in the main scanning direction. The belt edge signals detected by the photodetectors 3*a*, 3*b*, 3*c*, and 3*d* convey information about the position of the photoreceptor belt 1.

The belt edge signals detected by the photodetectors 3*a*, 3*b*, 3*c*, and 3*d* are compared with a signal indicating a previous position of the photoreceptor belt 1 at a belt edge synthesizer 7. The belt edge synthesizer 7 generates a belt edge signal to change an image data start position of a corresponding line according to a change in position of the photoreceptor belt 1. The synthesized belt edge signal is converted into an image scan start signal 114 indicating an image data start position of a corresponding line at a scanner control/synchronization module 9. The image scan start signal changes a start position of the image for each line according to the weaving of the photoreceptor belt 1 so that the image can always maintain a predetermined distance from the edge of a print paper and multi-color dots are arranged to be overlapped at the same position of the photoreceptor belt 1. In FIG. 1, reference numeral 11 denotes a computer for controlling a laser drive using the image scan start signal and a signal output from a controller 13 to control the overall image forming apparatus so that the laser beam can be output modulated using signals from the laser drive 108, 110, and 112 and the image scan start signal 114 from the scanner control/synchronization module 9 according to the image data.

Meanwhile, the belt edge signal passing through the belt edge synthesizer 7 is input to a belt steering controller 15. The belt steering controller 15 drives a belt steering motor (not shown) according to the belt edge signal so that the edge of the photoreceptor belt 1 can be driven at the center of the photodetectors 3*a*, 3*b*, 3*c*, and 3*d*.

The conventional registration system having the above structure controls the position of the photoreceptor belt 1 in the main scanning direction using a result obtained from Equation 1.

(Equation 1)

$Y=K_p\times$(the present belt position−the central position of photodetectors)$+K_D\times$(the present belt position−the previous belt position)

Here, KP is a proportional coefficient and KD is a differential coefficient. The Y value obtained from Equation 1 is used as a driving step number of a belt steering motor. When the belt steering motor drives a steering roller by a predetermined step according to the Y value, the steering roller is slant. Accordingly, a direction of movement of the photoreceptor belt 1 in the main scanning direction changes.

FIGS. 2 and 3 are graphs showing results of tests using the conventional registration system by changing the KP and KD values. FIG. 2 is a graph showing the output of a photodetector measuring an amount of change of the belt edge when KP and KD are 1 and 15, respectively. FIG. 3 is a graph showing the output of the photodetector when KP and KD are 0.5 and 10, respectively. To obtain the results of FIGS. 2 and 3, a product "PD S6967" having a length of 5 mm manufactured by HAMAMATSU is used as the photodetector. The maximum output voltage is set to 5 volts such that 1 volt corresponds to 1 mm in the weaving width of the belt. The photodetector is installed at the position separated 6 seconds from the belt steering apparatus. A 32 inches long sheet is used by being attached to the photoreceptor belt 1. Here, a step of a seam is about 330 $\mu$m, a parallelism thereof is 51 $\mu$m, and a drive speed of the belt is 3.2 inch/sec. To reduce an effect due to any defect of the photoreceptor belt 1, an output of the photodetector is accumulated for ten seconds.

Maximum weaving widths obtained from the above test conditions are 460 $\mu$m and 291 $\mu$m, respectively, as shown in FIGS. 2 and 3. The amounts of weaving with respect to the movement speed of the photoreceptor belt 1 are 3 $\mu$m/sec and 2 $\mu$m/sec, which means that, in the case of continuous printing, mis-registration of 300 μm (corresponding about 6 dots in the case of 600 dpi) or more from the edge of the paper to the image can be generated. Thus, when the conventional registration system is adopted, the scanning start point must be controlled in addition to the belt steering.

Because since the conventional registration system includes four photodetectors 3*a*, 3*b*, 3*c*, and 3*d* which receive laser beams scanned by scanners 5*a*, 5*b*, 5*c*, and 5*d* to form the image by color, and because calculations for the belt steering and color registration correction is performed at the belt edge synthesizer 7 using the belt edge signal for each color detected by the four photodetectors 3*a*, 3*b*, 3*c*, and 3*d*, the structure of the system is complicated and complicated calculations must be performed at the belt edge synthesizer 7.

When there is a defect at the edge of the photoreceptor belt 1 or the step of the seam generated by connecting the photoreceptor belt 1, a belt error signal is detected as if the position of the photoreceptor belt 1 is moved. To minimize the belt error signal, the outputs of the photodetectors 3*a*, 3*b*, 3*c*, and 3*d* are accumulated as long as the period of the photodetector belt 1 and the accumulated value are used as values of a present position of the photoreceptor belt 1.

Thus, in the conventional registration system, because the adjustment of the position of the photoreceptor belt 1 in the main scanning direction is delayed as long as the output of the photodetectors 3*a*, 3*b*, 3*c*, and 3*d* are accumulated for the period of the photoreceptor belt 1, the amount of weaving increases.

Also, in the conventional registration system, because the laser beams output from the scanners 5*a*, 5*b*, 5*c*, and 5*d* to form the an electrostatic latent image are used as the light source to detect the belt edge signals, the system can only be applied to the structure in which the photoreceptor belt 1 is used.

Further, in the conventional registration system, because the laser beam needs to be scanned for the photodetectors 3*a*, 3*b*, 3*c*, and 3*d* disposed out of an image area on the photoreceptor belt 1, the distance that the laser beam is scanned increases. Accordingly, the size of an optical element such as a mirror or a lens in the scanners 5*a*, 5*b*, 5*c*, and 5*d* should be increased.

SUMMARY OF THE INVENTION

To solve the above-described problems, in accordance with an aspect of the present invention, there is provided an active steering system and a method thereof which can minimize an amount of weaving of a belt by steering the belt based on a balance point at which the belt is driven most stably so that no additional registration correction is needed when the system and the method are applied to an image forming apparatus. There is also provided a method of seeking a balance point at which the belt is driven most stably.

In accordance with an aspect of the present invention, there is provided an active steering system including a drive source; a steering roller adjusting a belt in a widthwise direction, which is rotated by the drive source; a steering motor driving the steering roller; a steering controller controlling the steering motor; a belt edge sensor detecting a belt edge signal according to a position of the belt in the widthwise direction; and a main controller controlling the drive source and/or the steering controller where the belt is rotated based on a balance point at which an amount of change of at least one value of the belt edge signal and a step number of the steering motor is less than or equal to a predetermined value.

In accordance with an aspect of the present invention, when an average of step numbers of the steering motor for a predetermined time does not change within a predetermined range of allowance, a position corresponding to the average of the step numbers is set as the balance point.

In accordance with an aspect of the present invention, the predetermined time is a period of time the belt rotates one time.

In accordance with an aspect of the present invention, while the belt is rotated with respect to the balance point, the belt is controlled where the edge is located at a center of the photodetector.

In accordance with an aspect of the present invention, the active steering system further includes a memory storing data of the balance point.

In accordance with an aspect of the present invention, the balance point changes according to an operation of at least one sub-unit affecting the balance point, where the at least one sub-unit is installed in a predetermined apparatus to which the active steering system is applied, and is measured in advance and stored in the memory, and the belt is steered according to the balance point fit to the operation of the sub-unit.

In accordance with an aspect of the present invention, the belt is one of a photoreceptor belt, a transfer belt, a drying belt, a fusing belt, and a conveyance belt.

In accordance with an aspect of the present invention, the steering motor is driven at a predetermined step interval.

In accordance with an aspect of the present invention, the steering motor is driven at a larger step interval as the belt is located far away from a reference position with respect to the balance point, and at a smaller step interval as the belt is located close to the reference position.

In accordance with an aspect of the present invention, the steering motor is driven at a step interval at which a relationship between the belt edge signal and the step number of the steering motor satisfies a quadratic function.

In accordance with an aspect of the present invention, the light source includes at least one light emitting diode.

In accordance with an aspect of the present invention, there is provided a method of actively steering a belt in an active steering system including a drive source, a steering roller to adjust a belt in a widthwise direction which is rotated by the drive source, a steering motor to drive the steering roller, a steering controller to control the steering motor, a belt edge sensor to detect a belt edge signal according to a position of the belt in the widthwise direction, and a main controller to control the drive source and/or the steering controller where the belt is rotated based on a balance point at which an amount of change of at least one value of the belt edge signal and a step number of the steering motor is less than or equal to a predetermined value, the method including: according to the control of the main controller, driving the steering motor to move the steering roller to the balance point at which the amount of change in the at least one value of the belt edge signal and the step number of the steering motor is less than or equal to the predetermined value, and driving the drive source to rotate the belt in a proceeding direction; comparing the belt edge signal detected and a reference belt edge signal detected when the steering roller is located at the balance point; and when the belt edge signal is different from the reference belt edge signal, determining the step number of the steering motor changing from a reference step number with respect to the balance point, which corresponds to a degree of the belt edge signal deviating from the reference belt edge signal, and adjusting the position of the belt in the widthwise direction by moving the steering motor to the step number, wherein the position of the belt in the widthwise direction is controlled by repeating the comparing of the belt edge signal and the determining of the step number of the steering motor during the rotation of the belt.

In accordance with an aspect of the present invention, the belt edge sensor includes a light source, and a photodetector provided across at least one side edge of the belt where an amount of a light received, which is emitted from the light source, changes according to the position of the belt in the widthwise direction, and, when the steering roller is located at the balance point, the edge of the belt is controlled to be located at a center of the photodetector.

In accordance with an aspect of the present invention, where the seeking of the balance point occurs when the belt is newly installed or replaced, or when the balance point is changed.

In accordance with an aspect of the present invention, when an average of the step numbers of the steering motor for a predetermined time is the same as an average previously obtained within a predetermined range of allowance, a position of the steering roller corresponding to the average of the step numbers is set as a balance point.

In accordance with an aspect of the present invention, the predetermined time is a period of time the belt rotates one time.

In accordance with an aspect of the present invention, the balance point changes according to an operation of at least one sub-unit affecting the balance point, where the at least one sub-unit is installed in a predetermined apparatus to which an active steering system is applied and is measured in advance and stored in the memory, and the belt is steered with respect to the balance point fit to the operation of the sub-unit.

In accordance with an aspect of the present invention, there is provided a method of seeking a balance point at which a belt is driven stably to steer the belt using an active steering system, which includes a drive source, a steering roller to adjust a belt in a widthwise direction which is rotated by the drive source, a steering motor to drive the steering roller, a steering controller to control the steering motor, a belt edge sensor to detect a belt edge signal according to a position of the belt in the widthwise direction, and a main controller to control the drive source and/or the steering controller where the belt is rotated based on a balance point at which an amount of change of at least one value of the belt edge signal and a step number of the steering motor is less than or equal to a predetermined value, the method including: when the amount of the change of the at least one value of the belt edge signal and the step number of the steering motor is less than or equal to a value, obtaining an average by averaging the step numbers of the steering motor for a predetermined time; comparing the average of the step numbers and an average of the step numbers previously obtained; and when the average of the step numbers is the same as the average previously obtained of the step numbers within a predetermined range of allowance, determining a position of the steering roller corresponding to the average of the step numbers as the balance point.

In accordance with an aspect of the present invention, the seeking of the balance point is performed in a case in which the steering roller is moved to a position corresponding to a middle value of a step range of the steering motor or the step number corresponding to a previous balance point by driving the steering motor.

In accordance with an aspect of the present invention, the seeking the balance point is performed when the belt is newly installed or replaced, or when the balance point is changed.

In accordance with an aspect of the present invention, the method further includes storing the sought balance point.

In accordance with an aspect of the present invention, the driving of the steering motor, the comparing of the belt edge detected, and the determining of the step number are repeated by changing an operational state of at least one sub-unit to seek a first balance point when there is no effect by an operation of the sub-unit and a second balance point changed during the operation of the sub-unit, where an optimal belt steering can be performed even when the balance point is changed according to the operation of the sub-unit affecting the balance point, which is installed in an apparatus to which the active steering system is applied.

In accordance with an aspect of the present invention, the seeking the second balance point is repeated as many times as a number of balance points changed according to the operation of the sub-unit.

In accordance with an aspect of the present invention, there is provided a method of an active steering system, including: minimizing an amount of weaving of a belt by steering the belt based on a balance point at which the belt is driven most stably where no additional registration correction is needed when applied to an image forming apparatus.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and other aspects and advantages of the invention will become apparent and more readily appreciated from the following description of the embodiments, taken in conjunction with the accompanying drawings of which.

DETAILED DESCRIPTION OF THE INVENTION

Figure 1:
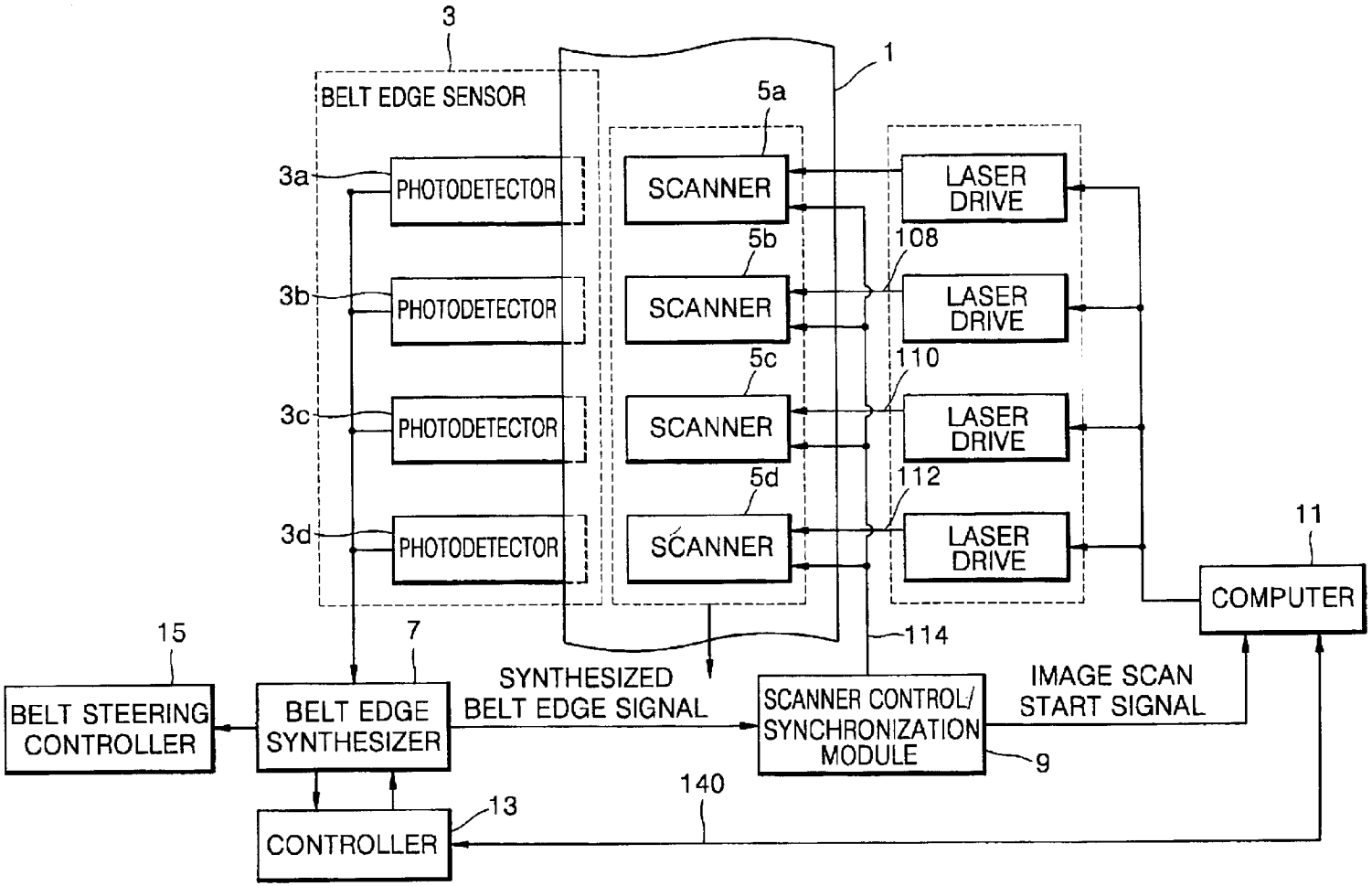
FIG. 1 (PRIOR ART)
FIG. 1 is a block diagram showing the structure of a conventional registration system.
Figure 2:
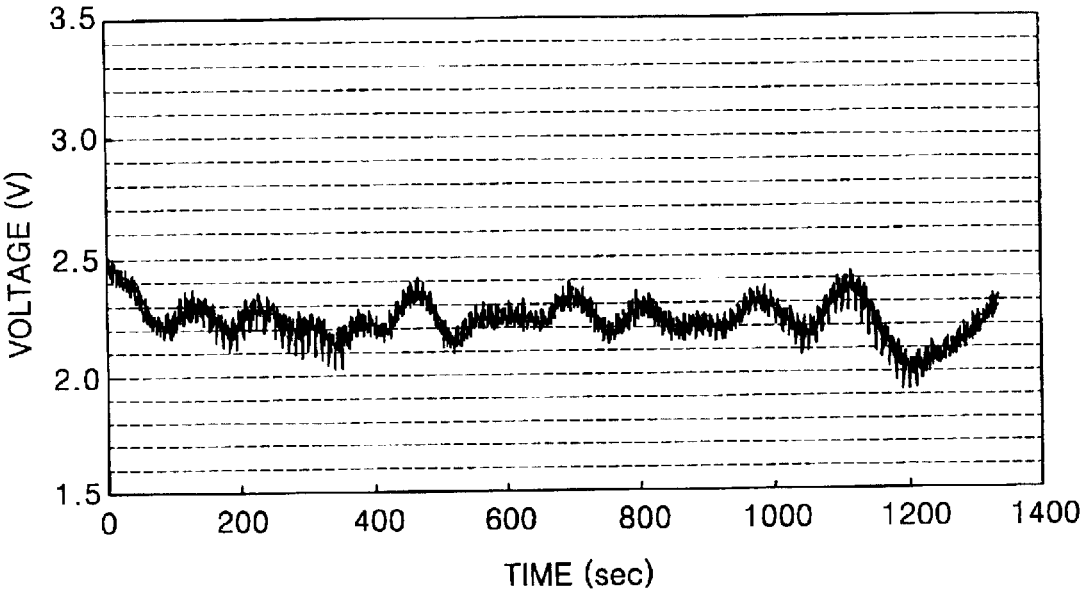
FIG. 2 (PRIOR ART)
FIGS. 2 and 3 are graphs showing results of tests performed to the registration system of FIG. 1.
Figure 3:
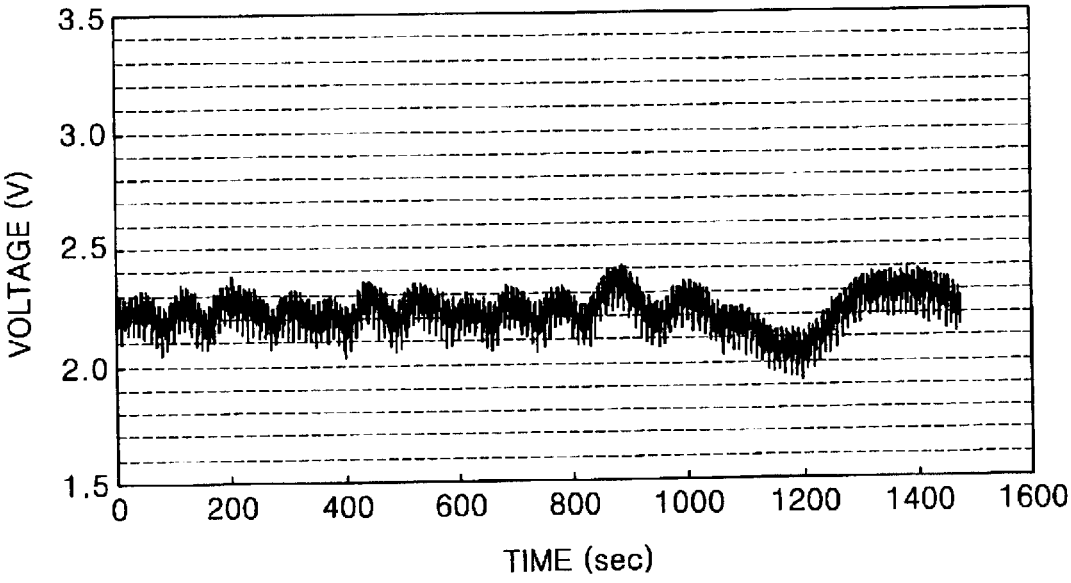
FIG. 3 (PRIOR ART)

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 4:
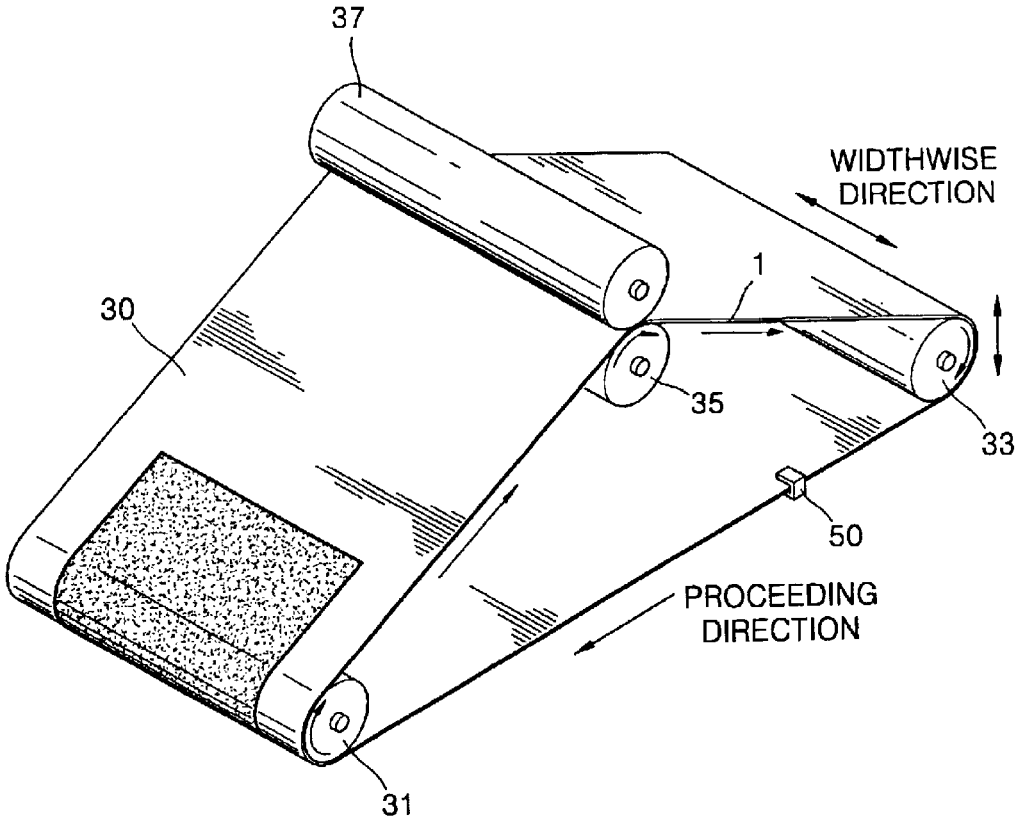
FIG. 4 is a perspective view of a belt system adopting an active steering system, according to an aspect of the present invention.
Figure 5:
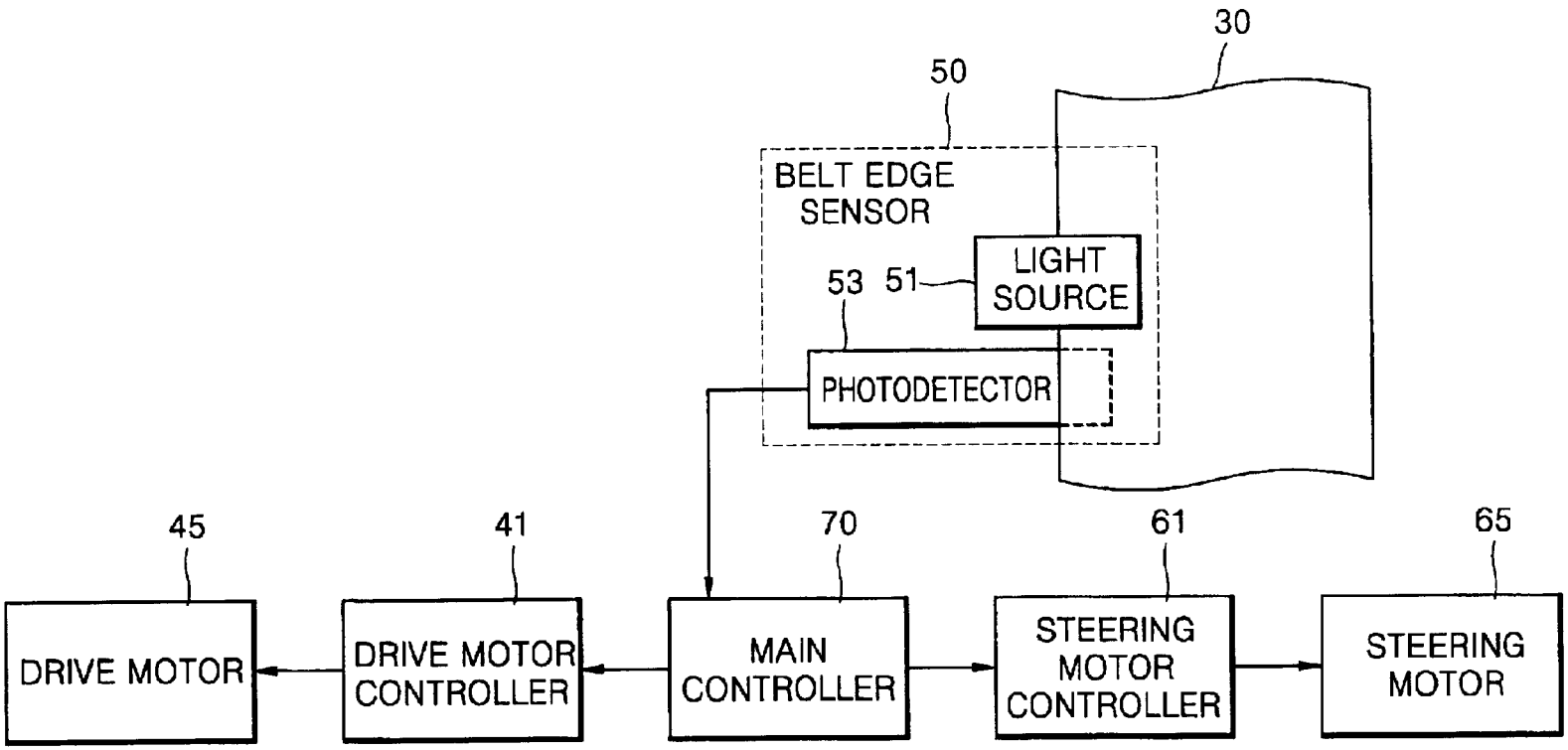
FIG. 5 is a block diagram showing a structure of the active steering system, according to an aspect of the present invention.

FIG. 4 is a perspective view of a belt system adopting an active steering system, according to an aspect of the present invention. FIG. 5 is a block diagram showing a structure of the active steering system, according to an aspect of the present invention. FIG. 4 shows an image forming apparatus adopting a photoreceptor belt as an example of the belt system.

Referring to FIGS. 4 and 5, the active steering system, according to an aspect of the present invention, includes a belt steering mechanism to control a position of a belt 30 in a widthwise direction rotated by a belt driving mechanism, for example, the position of the photoreceptor belt in a main scanning direction, a belt edge sensor 50 to detect a belt edge signal, and a main controller 70 to control the belt driving mechanism and/or the belt steering mechanism. Here, the belt driving mechanism includes a drive roller 31 to rotate the belt 30, a drive motor 45 to provide a drive force to the drive roller 31, and a drive motor controller 41 to control the drive motor 45.

The belt steering system includes a steering roller 33, a steering motor 65 to drive the steering roller 33, and a steering motor controller 61 to control the steering motor 65. The steering roller 33 supports the belt 30 capable of rotating by means of the belt driving mechanism, together with at least one roller, for example, the drive roller 31 and/or the guide roller 35. The belt 30 moves in the widthwise direction along the movement of the steering roller 33.

Figure 6:
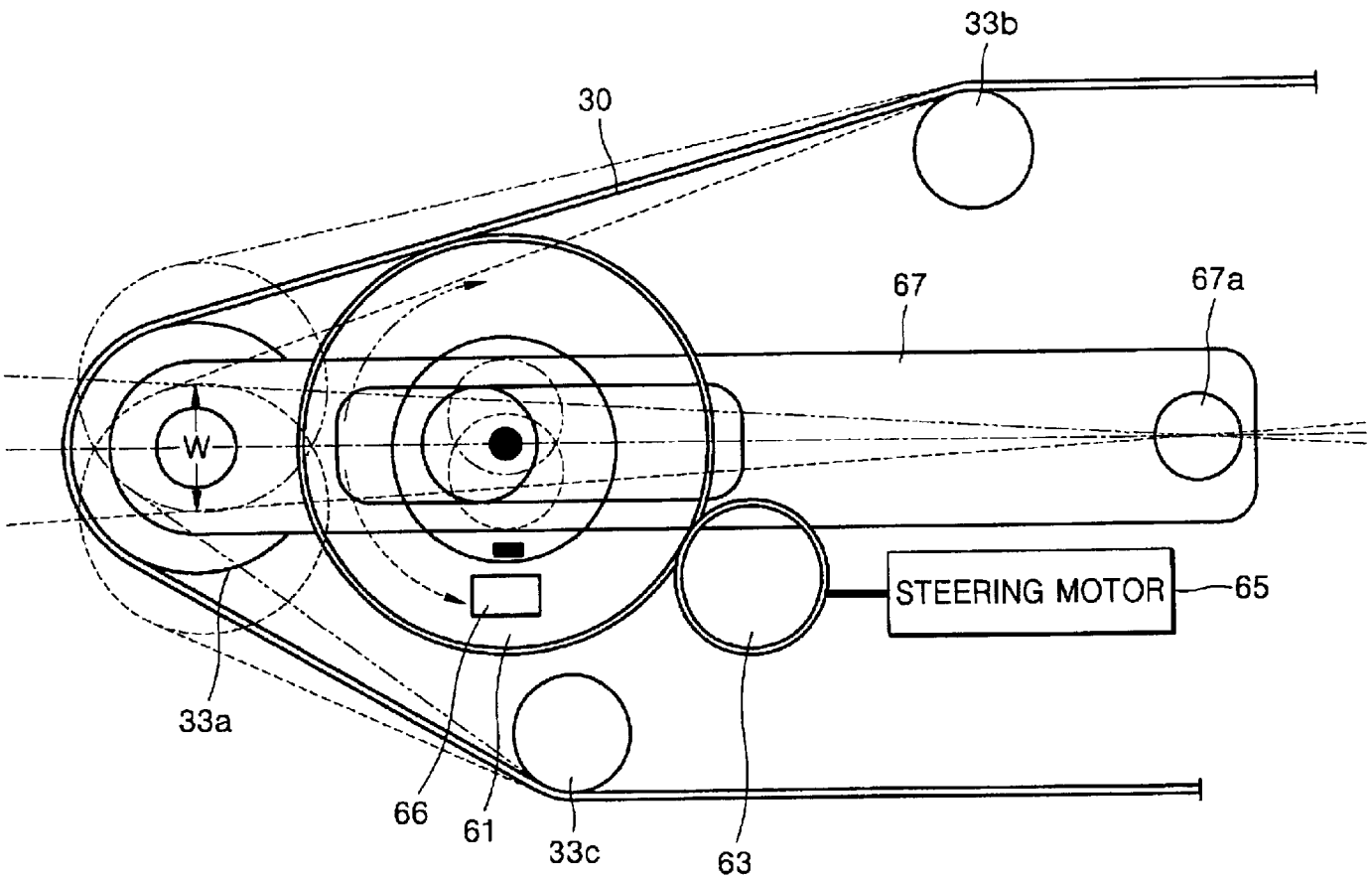
FIG. 6 is a view showing an example of a steering roller structure.

Here, a detailed structure of a steering roller structure including the steering roller 33 is well known in the art. An example of the steering roller structure is shown in FIG. 6. In FIG. 6, reference numeral 63 denotes a gear connected to the steering motor 65. A cam member 65 is installed between a main steering roller 33*a* and the gear 63. A steering roller home sensor 66 detects a center position of the main steering roller 33*a*. Reference letter W indicates a maximum width in a movement of the main steering roller 33*a*. The cam member 61 is geared into the gear 63 and has a cam structure to move the main steering roller 33*a*. The main steering roller 33*a* is interlinked to the cam member 61 via a pivot lever 67 pivoting around a pivot shaft 67*a*. FIG. 6 shows an example of the steering roller 33 including the main steering roller 33*a* and auxiliary steering rollers 33*b* and 33*c*.

The belt edge sensor 50 includes a light source 51 and a photodetector 53. The photodetector 53 is disposed across at least one edge of the belt 30 where an amount of received light emitted from the light source 51 is changed according to a position in the main scanning direction of the belt 30.

For instance, at least one light emitting diode (LED) to emit light across the edge of the belt 30 may be provided as the light source 51. Here, the light source 51 can be formed of a light emitting diode array.

According to an aspect of the present invention, to minimize an amount of weaving of the belt 30, the main controller 70 controls a motor controller and/or a steering controller using a belt edge signal detected from the belt edge sensor 50 so that the belt 30 is steered with respect to a balance point at which the belt 30 can be driven most stably. The main controller 70 performs a function of controlling the overall operation of the belt system.

Figure 7:
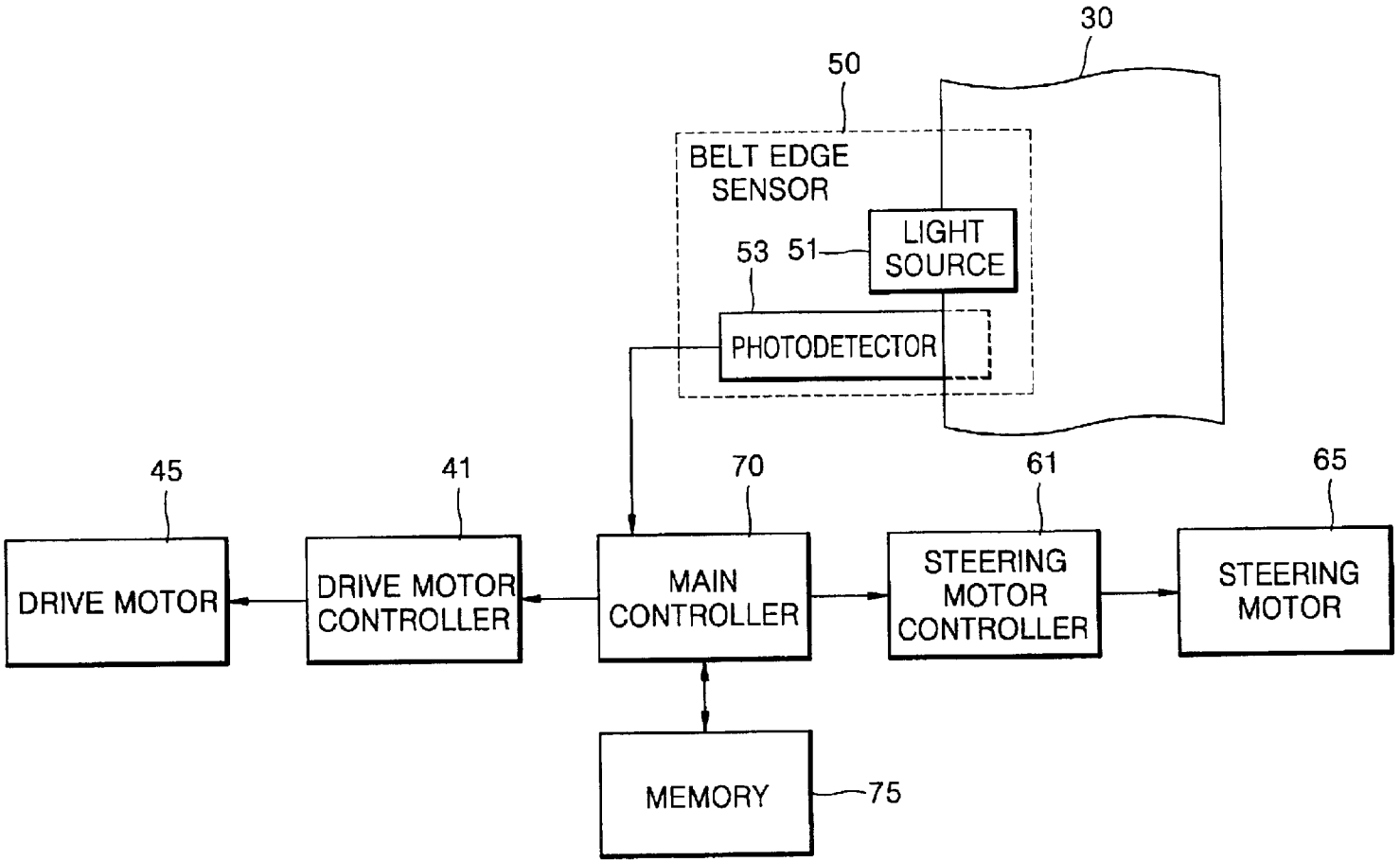
FIG. 7 is a block diagram showing the structure of the active steering system, according to another aspect of the present invention.

Furthermore, as shown in FIG. 7, the active steering system, according to an aspect of the present invention, further provides a memory 75 to store balance point data. The memory 75 can be included in the main controller 70 or may be provided separately.

In the active steering system having the above structure, according to an aspect of the present invention, because the belt 30 is steered based on the balance point at which the belt can be driven most stably, the amount of weaving of the belt 30 can be minimized. Thus, in the image forming apparatus adopting the above active steering system, a stable image output can be obtained without an additional registration correction circuit. Also, the active steering system, according to an aspect of the present invention, can actively seek the balance point, which is a reference in steering to minimize the amount of weaving of the belt 30.

Figure 8:
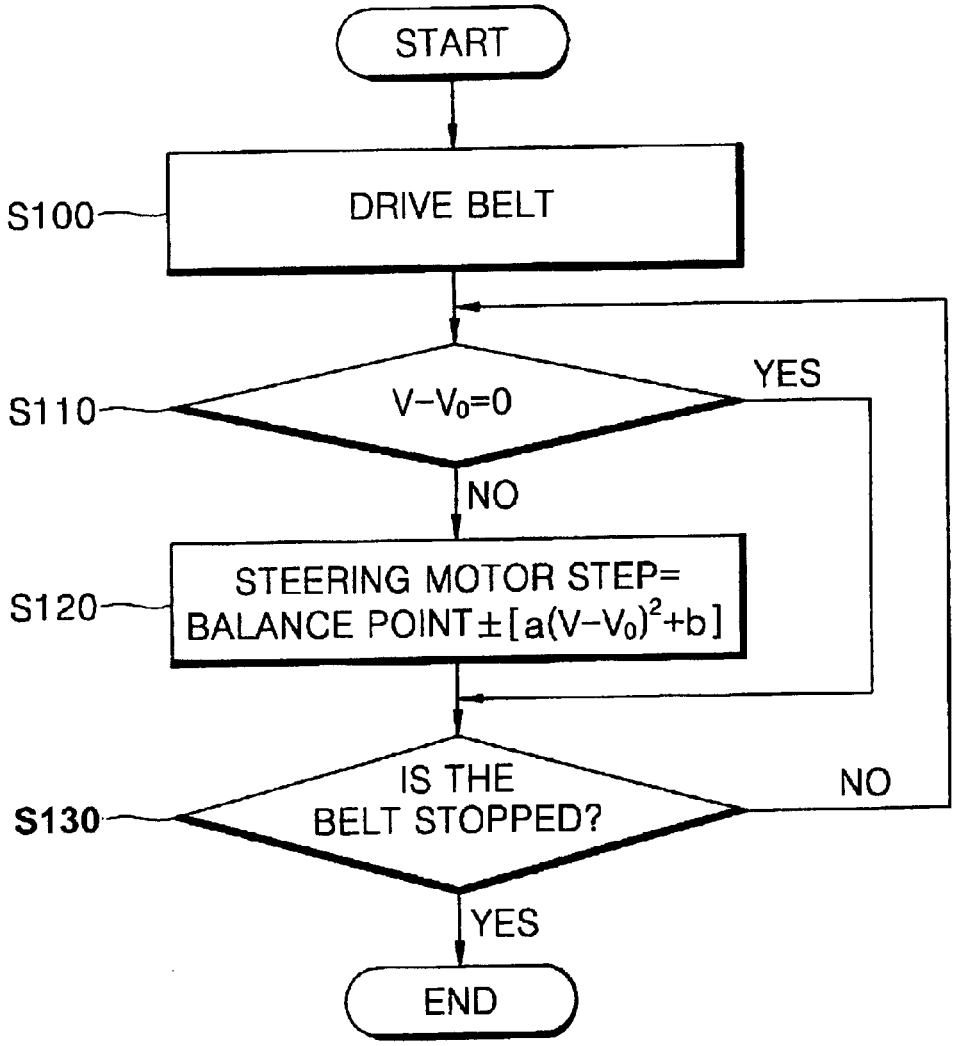
FIG. 8 is a flow chart showing an active steering method, according to an aspect of the present invention based on a balance point using an active steering system of the present invention.

FIG. 8 shows an example of an active steering method based on the balance point using the active steering system having the above structure according to an aspect of the present invention.

Referring to FIG. 8, first, according to a control of the main controller 70, at operation S100, the steering motor controller 61 drives the steering motor 65 to move the steering roller 33 to the balance point, and the drive motor controller 41 drives the drive motor 45 to circulate the belt 30 in a proceeding direction.

Here, when a new belt is installed, the belt is replaced, or the balance point is changed, the active steering system, according to an aspect of the present invention, obtains the balance point with respect to the present belt system state, and steers the belt 30 based on the obtained balance point.

When the belt 30 is rotated, a belt edge signal V is generated, which is proportional to a degree of the belt 30 blocking the photodetector 53 of the belt edge sensor 50. The belt edge signal V is input to the main controller 70. At operation S110, the main controller 70 compares the input belt edge signal V and a reference belt edge signal $V_o$. The reference belt edge signal $V_o$ is a belt edge signal detected when the edge of the belt 30 is disposed at a predetermined position on the photodetector 53, for instance, at the center thereof, in a state in which the steering roller 33 is located at the balance point.

In the comparison of the belt edge signal V and the reference belt edge signal $V_o$, if the sizes of both signals are found to be the same (within an allowed range), the belt 30 is continuously rotated. If not, the step number of the steering motor 65 is set according to a degree of the edge of the belt 30 deviating from the center of the photodetector 53. Then, at operation S120, the steering motor 65 is moved according to the set step number to adjust the position of the belt 30 in the widthwise direction. At operation S130, a determination is made whether the belt 30 has stopped. If the belt 30 has stopped, the active steering method stops. Otherwise, the active steering method returns to operation S110. As the above operations are repeated during the rotation of the belt 30, the position of the belt 30 in the widthwise direction (a main scanning direction of the photoreceptor belt or the transfer belt in the image forming apparatus) is controlled.

When steering the belt 30 based on the balance point, the drive of the steering motor 65 to determine the step number of the steering motor 65, according to the degree of the edge of the belt 30 deviating from the center of the photodetector 53, is performed according to the following principle. Specifically, the steering motor 65 can be driven at a constant step interval or at a step interval in which the relationship between the belt edge signal and the step number of the steering motor 65 (in other words, a positional relationship of the steering roller 33 according to the position of the belt 30 on the photodetector 53) satisfies a quadratic function.

Figure 9:
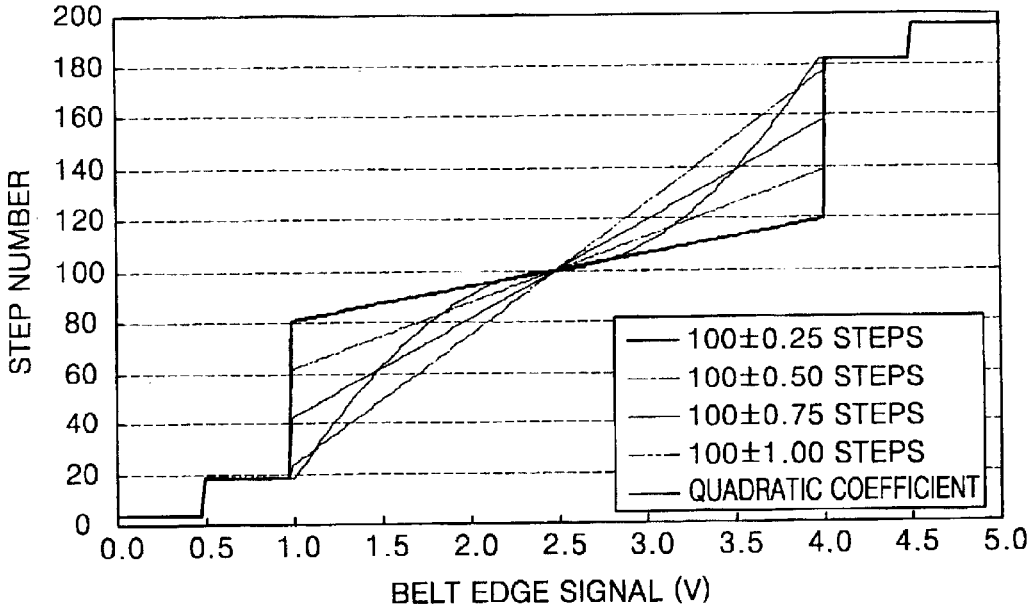
FIG. 9 is a graph showing a relationship between a belt edge signal detected by a belt edge sensor and a step position of a steering motor according to a drive step interval of the steering motor.

FIG. 9 shows the relationship between the belt edge signal detected by the belt edge sensor 50 and the step position of the steering motor 65 (represented by the step number) according to the drive step interval of the steering motor 65. In a graph of FIG. 9, when a controllable step of the steering motor 65 is in a range between 0–200 steps (capable of rotating between −90° to +90°) and the step number of the steering motor 65 is 100, there is a largest control range. If the balance point of the steering roller 33 is 100 steps, when the edge of the belt 30 is located at the center of the photodetector 53, the step number of the steering motor 65 is 100. Here, for example, when the belt 30 moves 0.1 mm in the widthwise direction, the belt edge signal is changed by 0.1 volt. As can be seen from FIG. 9, when the belt edge signal deviates by a predetermined size from the reference belt edge signal $V_o$ is detected, the step number of the steering motor 65 varies depending on the step interval used to control the steering motor 65.

Referring to FIG. 9, in the case in which the steering motor 65 is driven at a predetermined step interval, for example, a step interval of ±0.75, when the belt edge signal deviating 0.5 volts from 2.5 volts (V=2.0 volts or 3.0 volts) is detected, for example, the step number of the steering motor 65 must be moved a step of 19.25 (0.5×51×0.75) steps (17.325°). In contrast, in a case in which the steering motor 65 is driven at the step interval by which the relationship of the belt edge signal and the step number of the steering motor 65 (in other words, the positional relationship of the steering roller 33 according to the position of the belt 30 on the photodetector 53) satisfies a quadratic function (corresponding to a quadratic coefficient graph in FIG. 9), the belt edge signal deviates 0.5 volts from the 2.5 volts, for example, and the step number of the steering motor 65 moves 10.5 steps (9.450) from the balance point.

Figure 10:
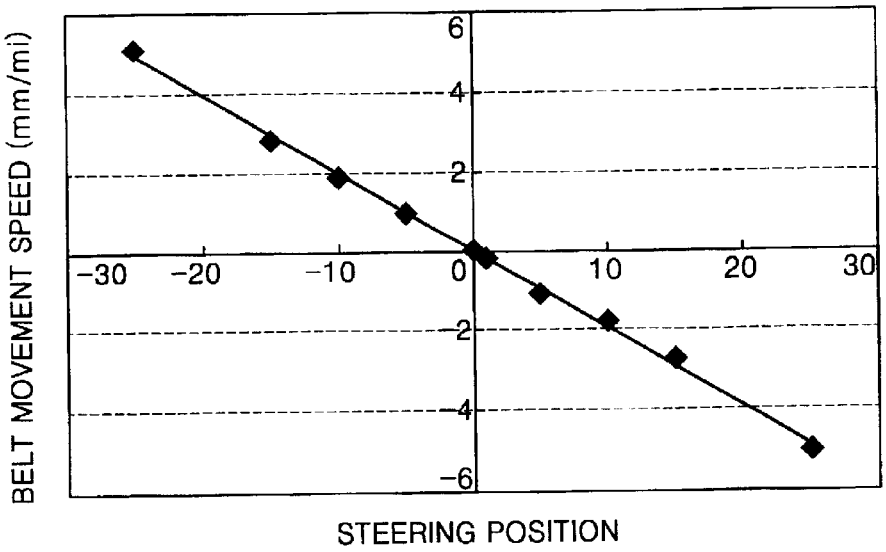
FIG. 10 is a graph showing a speed of the belt moving in a main scanning direction according to the steering position based on the balance point in the active steering system according to an aspect of the present invention.

FIG. 10 shows a speed of the belt 30 in the main scanning direction according to the steering position based on the balance point in the active steering system according to an aspect of the present invention. Here, when the step number of the steering motor 65 moves by 10 steps based on the balance point, the belt 30 moves at a speed of 2 mm/min toward the center of the photodetector 53. When the step number of the steering motor 65 moves by 20 steps based on the balance point, the belt 30 moves at a speed of 4 mm/min toward the center of the photodetector 53. That is, when being in the state of moving by 20 steps based on the balance point, the belt 30 moves from one end of the photodetector 53 to the other end thereof after 1.25 minutes pass.

As shown in FIG. 10, because the steering position is proportional to the movement speed of the belt 30, even when the steering motor 65 is driven at a predetermined step interval, the position of the belt 30 in the main scanning direction can be adjusted.

Also, as can be seen from FIG. 10, because the speed of movement of the belt 30 increases as the steering position deviates from the balance point, the maximum speed of the movement of the belt 30 increases as the range of the step of the steering motor 65 increases.

However, in the case in which the step interval at which the steering motor 65 is driven is constant, or when the steering motor 65 is driven at a small step, for example, a step of ±0.25 (a 100±0.25 step graph of FIG. 9 is applied), as can be seen from FIG. 9, a range of step in use is narrow and a lot of time is needed to move from the edge of the photodetector 53 to the center thereof. In the case in which the steering motor 65 is driven at the step interval of ±0.25 in FIG. 9, the step range is about 80 to 120 steps and every step of the steering motor 65 is not applied.

When the drive step interval of the steering motor 65 is small, because the step range is narrow, it is difficult to quickly move the belt 30 in the widthwise direction. Thus, when the weaving of the belt 30 is generated greatly, driving the steering motor 65 at a small step interval is not appropriate.

Also, when the steering motor 65 is driven at a large step interval, for example, a step interval of 1.00 (100±1.00 step graph of FIG. 9 is applied), although a sufficient step range can be used, because the step interval is large, the speed of the movement of the belt 30 is great. Thus, belt steering with respect to a fine weaving of the belt 30 around the balance point may be little difficult.

Thus, in the active steering system according to an aspect of the present invention, the steering motor 65 may be driven around the balance point at a small step interval using a feature where a degree of the step number of the steering motor 65 deviating from the step number corresponding to the balance point is proportional to the speed of the movement of the belt 30, so that the belt 30 can move slowly in the widthwise direction. Also, the steering motor 65 may be driven at a large step interval as the steering motor 65 is away from the balance point so that the belt 30 can move quickly in the widthwise direction.

That is, in the active steering system according to an aspect of the present invention, the steering motor 65 may be driven at the step interval at which the relationship between the belt edge signal and the step number of the steering motor 65 satisfies the quadratic function (the quadratic coefficient graph of FIG. 9 is applied). In the case in which the step of the steering motor 65 is adjusted, for example, according to the quadratic function of FIG. 8 (steering motor step=balance point $\pm[a(V-V_o)^2+b]$), when the amount of weaving of the belt 30 is great as the belt 30 is away from the balance point, the steering motor 65 is driven at a relatively large step interval so that an adjustment of the step number is made quickly. Accordingly, the belt 30 moves quickly toward the balance point (toward the center of the photodetector 53). At around the balance point where the amount of weaving of the belt 30 is small, the steering motor 65 is driven at a relatively small step interval so that the adjustment of the step number is made slowly. Accordingly, the adjustment of the position of the belt 30 is made slowly. That is, the belt 30 quickly moves near to the balance point in the widthwise direction and then moves slowly around the balance point. As a result, the belt 30 can move near the balance point in a short time and, when the adjustment is made with respect to the balance point, the amount of weaving of the belt 30 is considerably reduced. Thus, the weaving of the belt 30 is minimized so that an optimal belt steering is possible.

Here, the quadratic function graph of the step number of the steering motor 65, with respect to the belt edge signal shown in FIG. 9, shows a case in which the step of the steering motor 65 corresponding to the balance point is 100 steps. Further, the reference belt edge signal $V_o$ is 2.5 volts in the step function of the steering motor 65 of FIG. 8. A coefficient a of a quadratic term in the step function of the steering motor 65 of FIG. 8 denotes a slope.

Meanwhile, according to the active steering system of an aspect of the present invention, as shown in FIG. 9, because the step number of the steering motor 65 with respect to the position of the belt 30 in the main scanning direction (the size of the belt edge signal) can be set as a fixed value, even when the balance point changes during the operation of the belt system, a stable belt steering is possible. For example, when the balance point is changed in the image forming apparatus by the pressing or pressure removing actions of a fusing unit or a developing unit, or jitter due to feeding of sheets of thick paper by moving the steering motor 65 at the step number corresponding to the new balance point, the edge of the belt 30 is moved to the position corresponding to the change in the position of the step of the steering motor 65 from the center of the photodetector 53. When the belt 30 is stably controlled at the position deviating from the center of the photodetector 53, although the amount of weaving of the belt 30 may slightly increase, such increase is not so great to generate deviation of the image.

Figure 11:
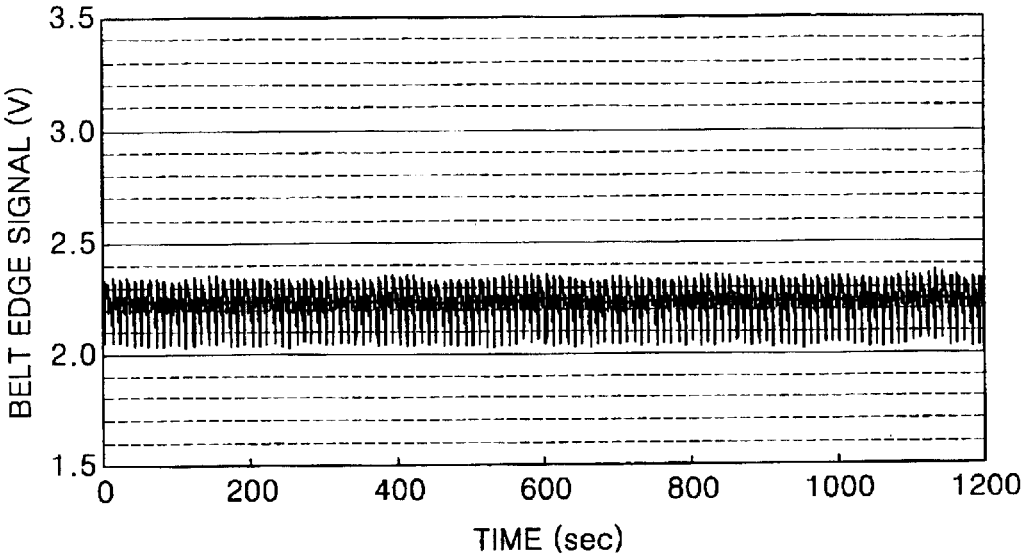
FIG. 11 is a graph showing the belt edge signal detected by the belt edge sensor when the steering motor is controlled to be driven at an interval of ±0.75 step.
Figure 12:
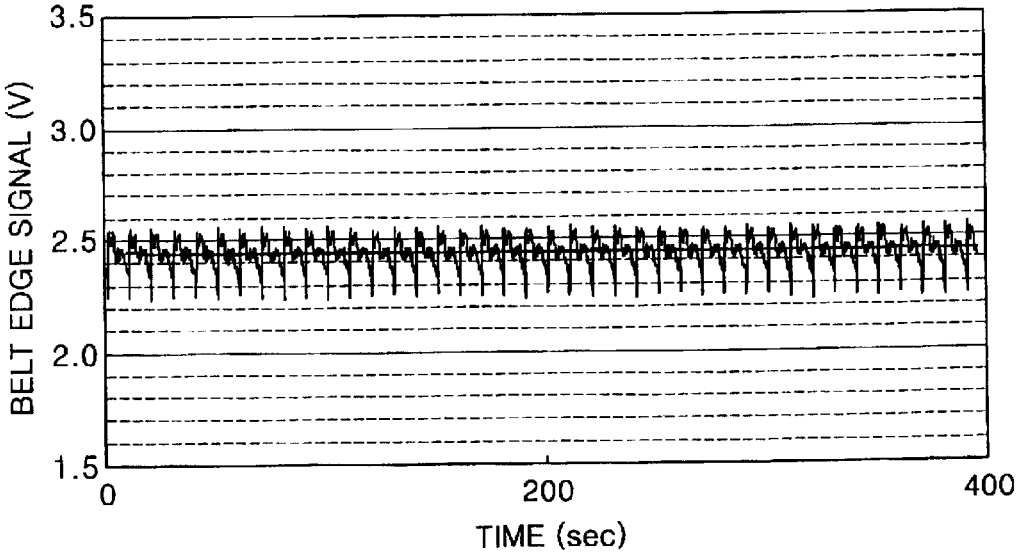
FIG. 12 is a graph showing the belt edge signal detected by the belt edge sensor when the steering motor is controlled to be driven at an interval of a step in which a relationship between a belt edge signal and a step number of the steering motor satisfies a quadratic function.

FIG. 11 shows the belt edge signal when the steering motor 65 is driven at a ±0.75 step interval (a 100±0.75 step graph of FIG. 8 is applied). FIG. 12 shows the belt edge signal when the steering motor 65 is driven at the step interval at which the relationship of the belt edge signal and the step number of the steering motor 65 satisfies the quadratic function (the quadratic coefficient graph of FIG. 8 is applied). FIGS. 11 and 12 show results of the cases in which the reference belt edge signal $V_o$ is 2.5 volts when the edge of the belt 30 is disposed at the center of the photodetector 53, and in which the belt edge signal changes by 0.1 volts when the edge of the belt 30 deviates 0.1 mm from the center of the photodetector 53.

In FIG. 11, the belt 30 is controlled at a position deviating 0.25 mm from the center of the photodetector 53 (the belt edge signal of 2.25 volts), that is, at the position of 2.25 mm assuming that the center of the photodetector 53 is located at the position of 2.5 mm. Although the above result is due to an incorrect balance point, because the amount of weaving of the belt 30 is quite small, registration is not affected at all. In FIG. 12, the belt 30 is controlled at the position deviating 0.05 mm from the center of the photodetector 53 (the belt edge signal of 2.45 volts), that is, at the position of 2.45 mm assuming that the center of the photodetector 53 is located at the position of 2.5 mm, which is due to an error in an output of the photodetector 53. As can be seen from FIGS. 11 and 12, the active steering system, according to an aspect of the present invention, although the balance point changes, the position of the belt 30 in the widthwise direction can be controlled very stably with respect to the new balance point.

Here, test conditions used to obtain the results of FIGS. 11 and 12 are as follows. The photoreceptor belt having a length of 32 inches is used and is connected as the belt 30. The step of a seam at the connected portion of the photoreceptor belt is about 330 $\mu$m and a parallelism thereof is 51 $\mu$m. The belt 30 is driven at a speed of 3.2 inches per second and the output of the photodetector 53 is averaged for 5 seconds. A minimum step interval of the steering motor 65 is 0.25 steps in a reduction ratio of 1:4. Accordingly, the steering roller 33 rotates by 0.2250. PD S6967 with a 5 mm window manufactured by HAMAMATSU is used as the photodetector 53. A maximum output (a maximum value of a belt edge signal) of the photodetector 53 is set to 5 volts. In this state, when the edge of the belt 30 moves by 1 mm on the photodetector 53, the size of the belt edge signal is changed by 1 volt. From the test result, it can be seen that there is a change in voltage of maximum 330 mV, which is due to the step of the seam. Thus, in FIGS. 11 and 12, maximum weaving amounts of the belt 30 excluding the effect by the shape of the belt 30 are 22 $\mu$m and 8 $\mu$m, respectively. Also, in FIGS. 11 and 12, the amounts (speed) of weaving of the belt 30 are 0.013 $\mu$m and 0.006 $\mu$m during 1 second, respectively.

Accordingly, when the belt 30 is steered by the active steering system, according to an aspect of the present invention, the weaving of the belt 30 is hardly generated so that the amount of weaving of the belt 30 does not affect the image at all. Also, the result shows that the steering of the steering motor 65 at the step interval at which the relationship between the belt edge signal and the step number of the steering motor 65 satisfies the quadratic function shows a superior feature.

Thus, when the belt 30 is steered using the active steering system, according to an aspect of the present invention, because weaving of the belt 30 causing the mis-registration and the color registration in the image is not generated in an image, for example, a belt edge synthesizer is not needed unlike a conventional registration system. Also, because the position of the belt 30 in the main in scanning direction is strictly controlled, a measurement of the position of the belt 30 to determine a scanning start point for each color image is not necessary and one belt edge sensor 50 is sufficient. That is, when the active steering system, according to an aspect of the present invention is adopted, an additional registration correction circuit is not needed.

Figure 13:
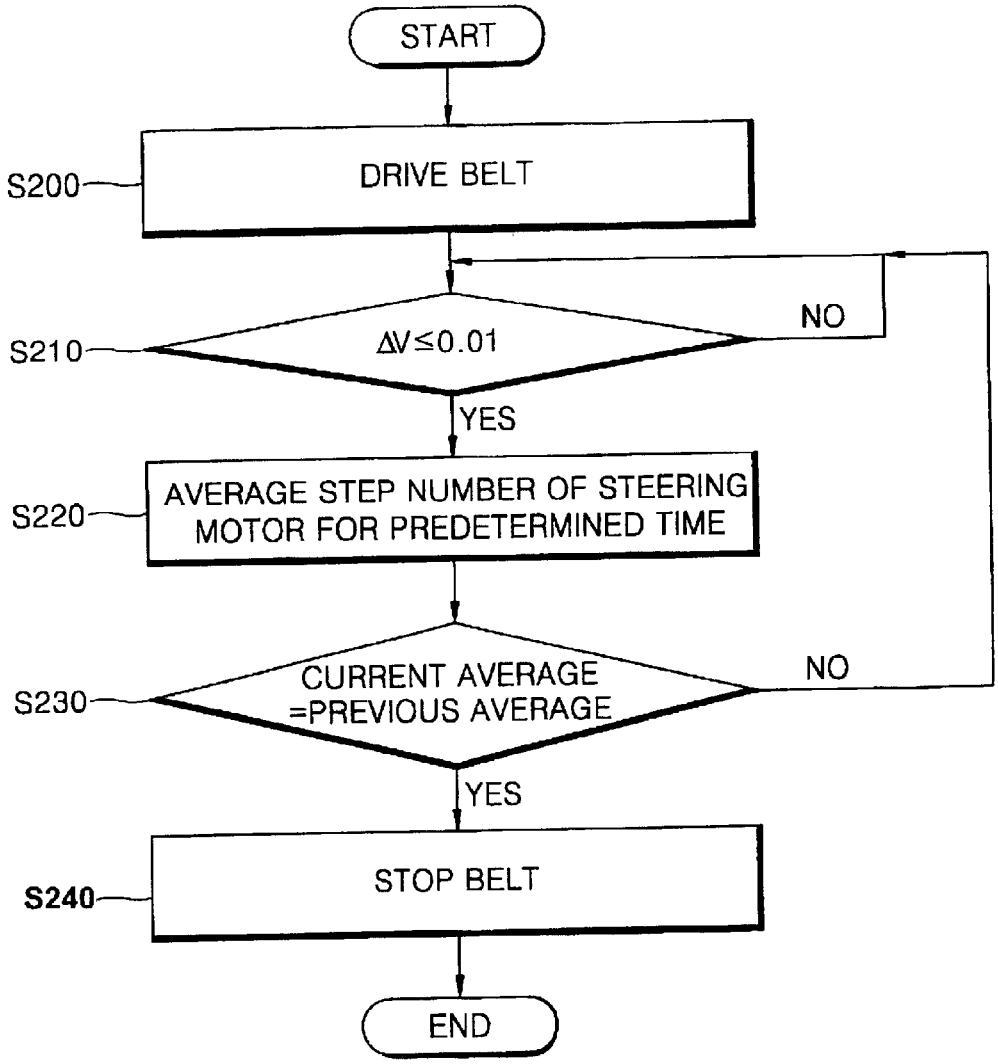
FIG. 13 is a flow chart showing a method of seeking the balance point, according to an aspect of the present invention.

Meanwhile, in the active steering method, according to an aspect of the present invention, the balance point for optimal belt steering, which can minimize the amount of weaving of the belt 30 can be sought through a process shown in FIG. 13. A process of seeking the balance point may be performed whenever the belt 30 is first installed in the belt system, the belt 30 is replaced, or the balance point is changed.

Referring to FIG. 13, according to the control of the main controller 70, the steering motor controller 61 drives the steering motor 65 to move the steering roller 33 to a position corresponding to the step number (data stored in the memory 75) corresponding to a middle value in a range of step or in the conventional balance point of the steering motor 65. Then, at operation S200, the drive motor controller 41 drives the drive motor 45 to rotate the belt 30 in a proceeding direction.

Next, the belt edge signal corresponding to a degree of the belt 30 blocking the photodetector 53 of the belt edge sensor 50 is detected during rotation of the belt 30. At operation S210, when, as the position of the belt 30 in the widthwise direction is adjusted, the amount of change in the belt edge signal is less than or equal to a predetermined value (for example, 0.01 volt) or the amount of change in the step number of the steering motor 65 in a state in which the amount of change in the belt edge signal is less than or equal to a predetermined value is less than or equal to a predetermined value, at operation S220, the step number (or the belt edge signal) of the steering motor 65 is averaged for a predetermined time (for instance, a period in which the belt 30 rotates one time). Whether the average of the step number (or the belt edge signal) for a predetermined time is the same as the previous average within a range of allowance is determined. If the average is not the same as the previous average, the position of the belt 30 in the widthwise direction is adjusted based on the position (steering position) of the steering roller 33. The position of the steering roller 33 corresponds to the average of the presently calculated step number (or belt edge signal) and a step of averaging the step value of the steering motor 65 for a predetermined time (for instance, a period in which the belt 30 rotates one time). Furthermore, the obtained average is compared with the previous average and is repeated until an amount of change of the belt edge signal (or the step number of the steering motor 65) is less than or equal to a predetermined value. At operation S230, when the calculated average of the step number of the steering motor 65 (or belt edge signal) is the same as the previous value within a range of allowance, the position of the steering roller 33 corresponding to the average is set as a balance point. At operation S240, the process of seeking the balance point is terminated.

Figure 14:
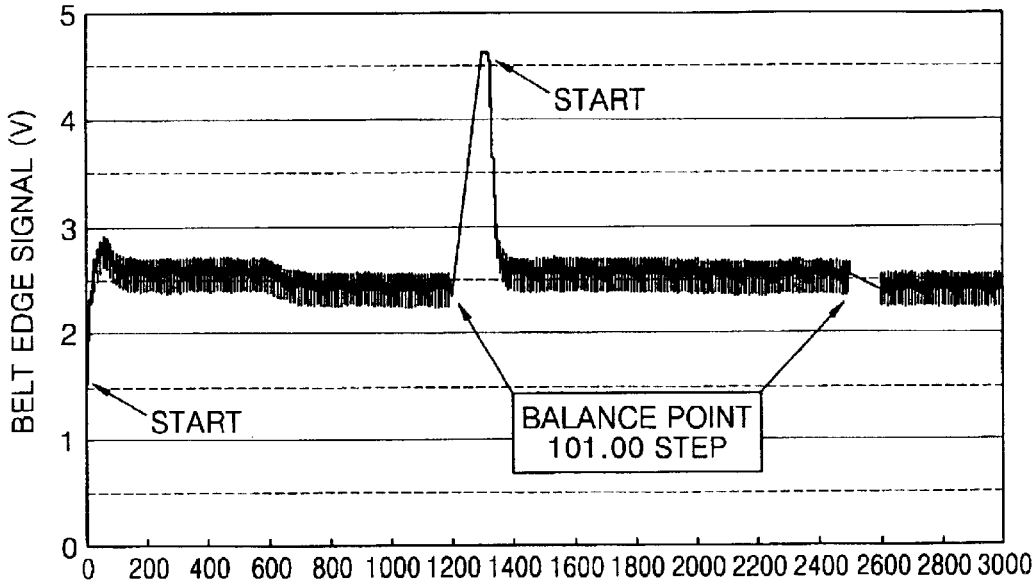
FIG. 14 is a graph showing an output of the belt edge sensor when a program to automatically obtain the balance point by applying the process of FIG. 13 is executed.

FIG. 14 shows the output of the belt edge sensor 50 when a program to automatically obtain the balance point by using the above process is executed. In the graph of FIG. 14, a start portion shows a result of seeking the balance point when the edge of the belt 30 is initially located at the position of 1.5 mm on the photodetector 53 while a middle pattern of the graph shows a result of seeking the balance point after the belt 30 is forcedly moved to the position of 4.6 mm on the photodetector 53. In both cases, the step number of the steering motor 65 at the balance point is 101.00 step. In FIG. 14, a last portion shows the belt edge signal when the belt 30 is driven while the belt 30 is steered with respect to the balance point after the balance point is sought.

In the meantime, as described above, the belt system adopting the active steering system, according to an aspect of the present invention, may include at least one sub-unit affecting a balance point at which the amount of weaving of the belt 30 is minimized.

In a case of the image forming apparatus using the photoreceptor belt, the balance point to drive the photoreceptor belt is changed due to an operation of various sub-units, such as the pressing of the transfer roller 37 of FIG. 4 pressing the photoreceptor belt, the lift-up of a developing unit, feeding of sheets of thick paper, and/or contact by a cleaning apparatus, after printing starts, which results in the weaving of the photoreceptor belt.

Figure 15:
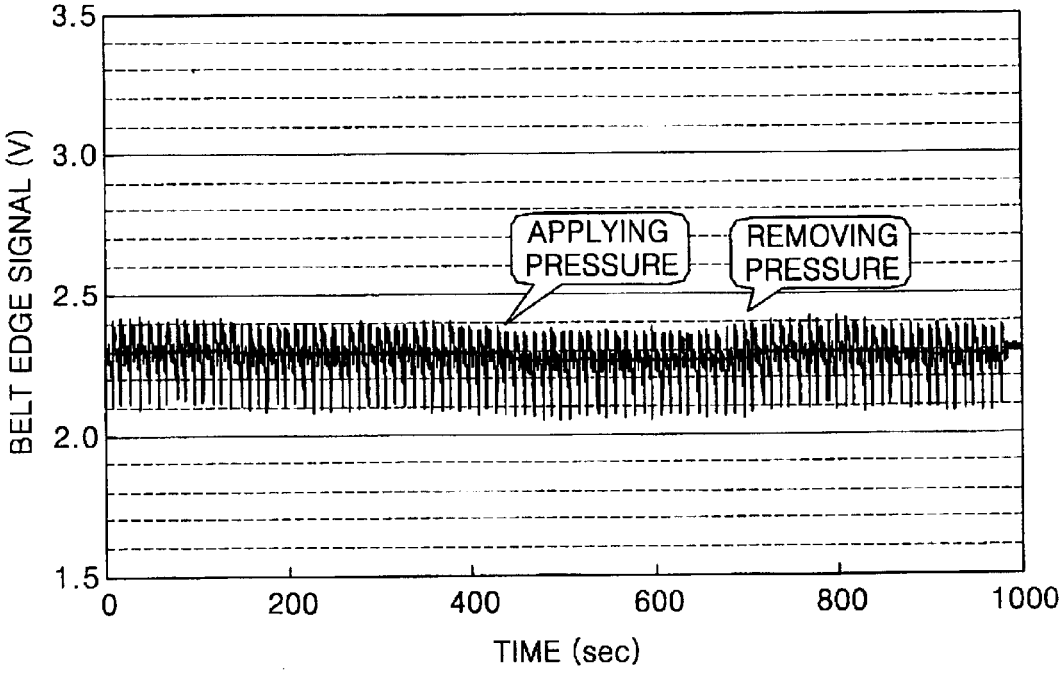
FIG. 15 is a graph showing the belt edge signal detected by the belt edge sensor when a transfer roller is pressed at 44.3 kg and the pressure is removed in an image forming apparatus using a photoreceptor belt.
Figure 16:
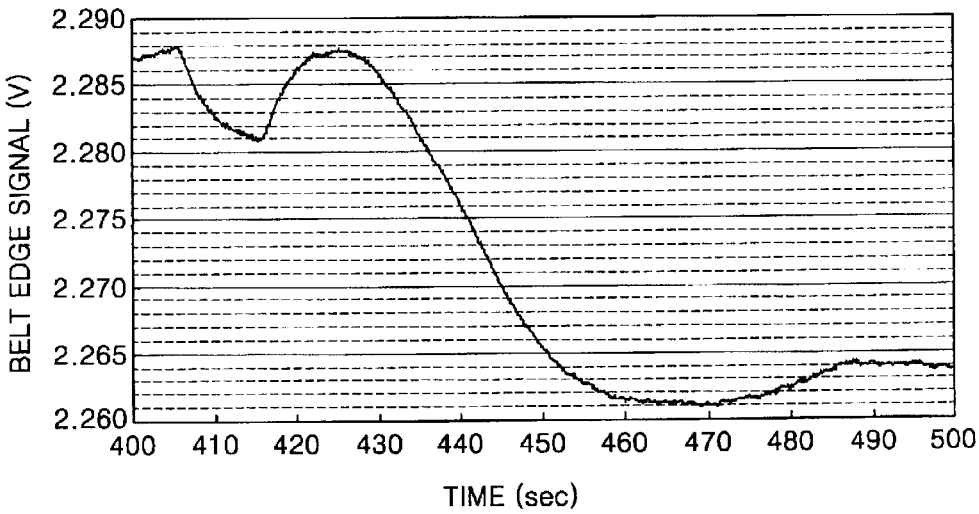
FIG. 16 is a graph showing a pressed portion of FIG. 15.

FIG. 15 is a graph showing the belt edge signal detected by the belt edge sensor 50 when the transfer roller 37 in the image forming apparatus using a photoreceptor belt is pressed at 44.3 kg and then the pressure is removed. FIG. 16 is a graph showing a pressed portion of the belt edge signal of FIG. 15 by magnifying the same. The results of FIGS. 15 and 16 are obtained by using the conditions for the tests used to obtain the result of FIGS. 11 and 12 and the relationship between the belt edge signal and the step number of the steering motor 65 are obtained using the conditions satisfying the quadratic function.

According to results of tests performed, the amount of weaving of the photoreceptor belt is measured to be the maximum 27 $\mu$m when pressed, and 36 $\mu$m when the pressure is removed, and the maximum movement speed is 2 $\mu$m/sec. The above values result in a deviation of 0.5 dots when a resolution is 600 dpi. Because the above test is performed when the transfer roller only is pressed, when the other sub-units affecting during actual printing of the image forming apparatus are taken into consideration, the amount of weaving of the photoreceptor belt increases.

As can be seen in FIG. 8, because the step number of the steering motor 65 can be set as a fixed value according to the position of the belt 30, when the belt 30 is steered by using the above-described active steering system, according to an aspect of the present invention, the belt 30 can be stably steered at the new balance point. Thus, even when the balance point changes with the pressure from the sub-unit, such as the transfer roller, the steering of the belt 30 is hardly affected. However, the weaving of the belt 30 may be a problem during which pressure is applied or removed by the sub-unit.

As in the test results of FIGS. 15 and 16, when the balance point changes as the transfer roller is pressed at 44.3 kg (in the period of about 40 seconds as shown in FIG. 16), because the belt 30 moves 27 $\mu$m in the main scanning direction, the output image changes 27 $\mu$m during 40 seconds. When actions such as feeding thick paper or contact by the developing unit, which may cause a change of the balance point, are made concurrently, weaving of the belt 30 due to the change of the balance point becomes greater.

Thus, in the active steering system, according to an aspect of the present invention, balance points to be changed after the operations of various sub-units are measured in advance and stored in the memory 75. When at least one sub-unit is operated after the belt 30 is driven, the belt 30 may be steered by changing the balance point to compensate for the weaving of the belt 30 due to the change of the balance point, so that the weaving of the belt 30 can be prevented in advance. Here, the belt steering performed fit to each of the operational situation may be made in the state in which the edge of the belt 30 is located at a predetermined position, for example, at the center, on the photodetector 53.

Figure 17:
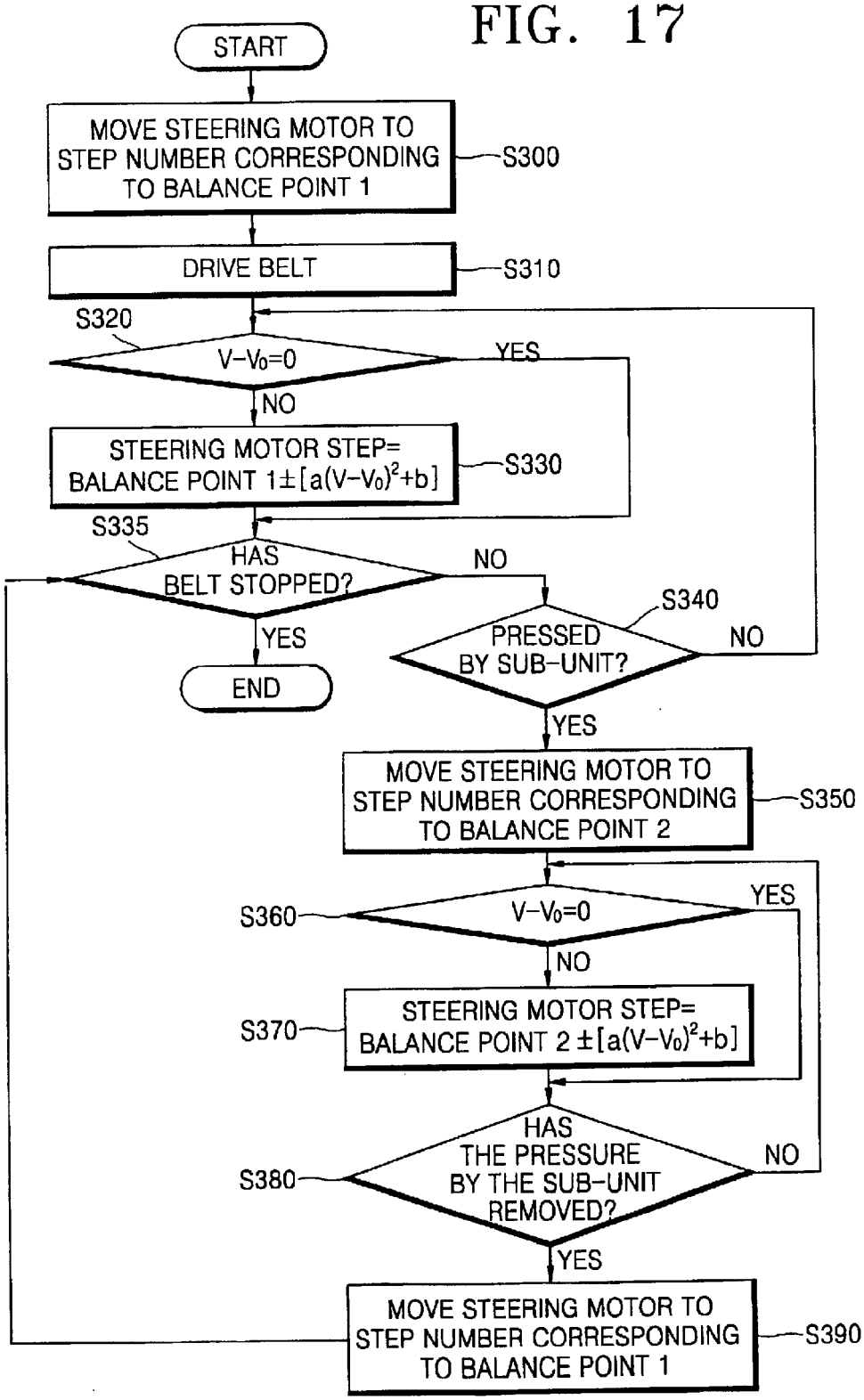
FIG. 17 is a flow chart showing the active steering method, according to another aspect of the present invention, based on an appropriate balance point according to an operation of the belt system by using the active steering system of the present invention.

FIG. 17 shows an active steering method based on an appropriate balance point according to an operational situation of the belt system using the active steering system, according to an aspect of the present invention. Referring to FIG. 17, at operation S300, the steering motor controller 61 drives the steering motor 65 according to the control of the main controller 70 to move the steering roller 33 to the position of a balance point 1 stored in the memory 75. At operation S310 the steering motor controller 61 drives the drive motor 45 to rotate the belt 30 in the proceeding direction.

The balance point 1 is a steering position at which the amount of weaving of the belt 30 can be minimized as the belt 30 is driven most stably when pressure from any other sub-unit does not exist.

When the belt 30 is rotated, the belt edge signal is output according to a degree of the belt 30 blocking the photodetector 53 of the belt edge sensor 50. The belt edge signal is input to the main controller 70. At operation S320, the main controller 70 compares the input belt edge signal V and the reference belt edge signal $V_o$. Here, the reference belt edge signal $V_o$ means the belt edge signal detected when the edge of the belt 30 is located at a predetermined position on the photodetector 53, for instance, at the center of the photodetector 53 as in the above-described aspect of the present invention, when the steering roller 33 is located at the balance point 1.

In the comparison of the belt edge signal V and the reference belt edge signal $V_o$, if the sizes of the belt edge signal V and the reference belt edge signal $V_o$ are the same (within a range of allowance), the belt 30 continues to rotate in the same state. If the sizes of the belt edge signal V and the reference belt edge signal $V_o$ are not the same, at operation S330, a step number is set according to a degree of the edge of the belt 30 deviating from the center of the photodetector 53, and the position of the belt 30 in the widthwise direction is adjusted by moving the steering motor 65 by the set step number. As the belt 30 is rotated, the above operations S320 and S330 are repeated and the position of the belt 30 in the widthwise direction is controlled.

Because operation S335 of steering the belt 30 with respect to the balance point 1 is the same as in the above-described aspect of the present invention except for the fact that the balance point is changed to the balance point 1 (the balance point in the previous embodiment and the balance point 1 can be the same), the description thereof will be omitted.

Here, the step number of the steering motor 65 can be set using the graph of FIG. 9, for instance, a quadratic coefficient graph, as in the above-described aspect of the present invention. To obtain the step number of the steering motor 65 according to the belt edge signal, the balance point 1 is used. Here, the reference step number of the steering motor 65 corresponding to the balance point 1 may be 100 or other values. If the reference step number of the steering motor 65 corresponding to the balance point is not 100 steps, by moving the graph of FIG. 9 parallel to the vertical axis to the reference step number of the steering motor 65 corresponding to the balance step from the 100 steps, the step number corresponding to the belt edge signal can be determined by using the graph of FIG. 9, regardless of the reference step number of the steering motor 65 corresponding to the balance point.

At operation S340, as the belt 30 is rotated to be steered, when pressure by at least one sub-unit is generated, the main controller 70 reads a value of a balance point 2 stored in the memory 75. At operation S350, the steering motor controller 61 drives the steering motor 65 to move to the step number corresponding to the balance point 2 according to the control of the main controller 70, so that the steering roller 33 is located at the balance point 2.

Then, at operation S360, while the belt 30 is rotated at the balance point 2, the belt edge signal V detected by the belt edge sensor 50 and the reference belt edge signal $V_o$ are compared. If the belt edge signal V and the reference belt edge signal $V_o$ are not the same within a range of allowance, at operation S370, the step number of the steering motor 65 according to the belt edge signal is determined using the same principle as in the case of determining the step number of the steering motor 65 during the belt steering with respect to the balance 1. The steering motor 65 is moved to the set step number to adjust the position of the belt 30 in the widthwise direction. While the belt 30 is rotated in the state of being pressed by the sub-unit the above operations S360 and S370 are repeated and the position of the belt 30 in the widthwise direction is controlled with respect to the balance point 2.

Although there is a pressure by the sub-unit, the step number of the balance point 2 read out from the memory 75 may be applied only when the step number of the steering motor 65 is determined, when the belt edge signal V detected by the belt edge sensor 50 and the reference belt edge signal $V_o$ at the balance point 2 are compared, and the belt edge signal V and the reference belt edge signal $V_o$ are not the same within a range of allowance. Here, operation S350, in which the step number of the steering motor 65 is moved to the balance point 2 after the value of the balance point 2 stored in the memory 75 is read out, is omitted.

Here, the balance point 2 is a balance point changed due to the pressure by at least one sub-unit. As many data about the balance point 2 as the number of operations of the sub-unit causing a change in the balance point are stored in the memory 75. Whenever the operational situation of the sub-unit changes, the main controller 70 reads the appropriate value of the balance point 2 from the memory 75 so that the belt steering is made accordingly.

At operation S380, when the pressure of the sub-unit is removed at operation S390, the main controller 70 changes the step number of the steering motor 65 to a value corresponding to the balance point 1 and continuously steers the belt 30 with respect to the balance point 1 or stops the belt 30.

In the same test conditions as those used to obtain the result of FIG. 15, it is assumed that the step number corresponding to the balance point 1 is 101.00 steps when there is no pressure by the sub-unit, and that the step number corresponding to the balance point 2 is 101.25 steps when the transfer roller is pressed by the pressure of 44.3 kg. Then, when there is no pressure by the sub-unit, the steering motor 65 is moved to 101.00 steps and then, the drive motor 45 is driven. Here, assuming that the belt edge signal is 3.0 volts, the steering motor 65 is moved to (101.00+10.5) steps. When the transfer roller is pressed, the balance point changes to 101.25 steps. Then, when the belt edge signal becomes 3.0 volts, the steering motor 65 is moved to (101.00+10.5) steps.

Figure 18:
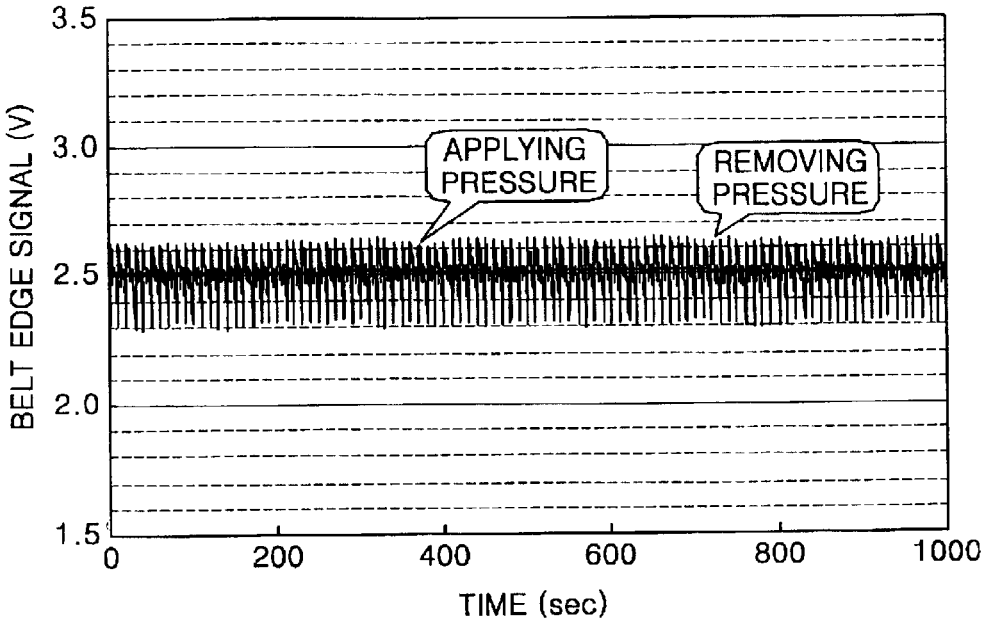
FIG. 18 is a graph measuring the belt edge signal output from the belt edge sensor when the transfer roller is pressed at 44.3 kg and the pressure is removed by using the active steering method, according to another aspect of the present invention.

FIG. 18 shows the belt edge signal output from the belt edge sensor 50 when the transfer roller is pressed at 44.3 kg and then the pressure is removed, by applying the active steering method, according to another aspect of the present invention, under the same test conditions as in FIG. 15. Referring to FIG. 18, the amount of weaving of the belt 30 is the maximum 7 $\mu$m, when pressed, and the maximum 9 $\mu$m, when the pressured is removed. The movement speed of the belt 30 is 0.00016 $\mu$m/sec. The amount of weaving and the movement speed of the belt are almost the same as those when the belt 30 is driven in the state in which the transfer roller is not pressed.

As can be seen from the above, by adopting the active steering method according to another aspect of the present invention, because the amount of weaving of the belt 30 can be controlled within a few micrometers even when pressure is applied or removed by at least one sub-unit, an additional registration correcting apparatus is not needed.

Figure 19:
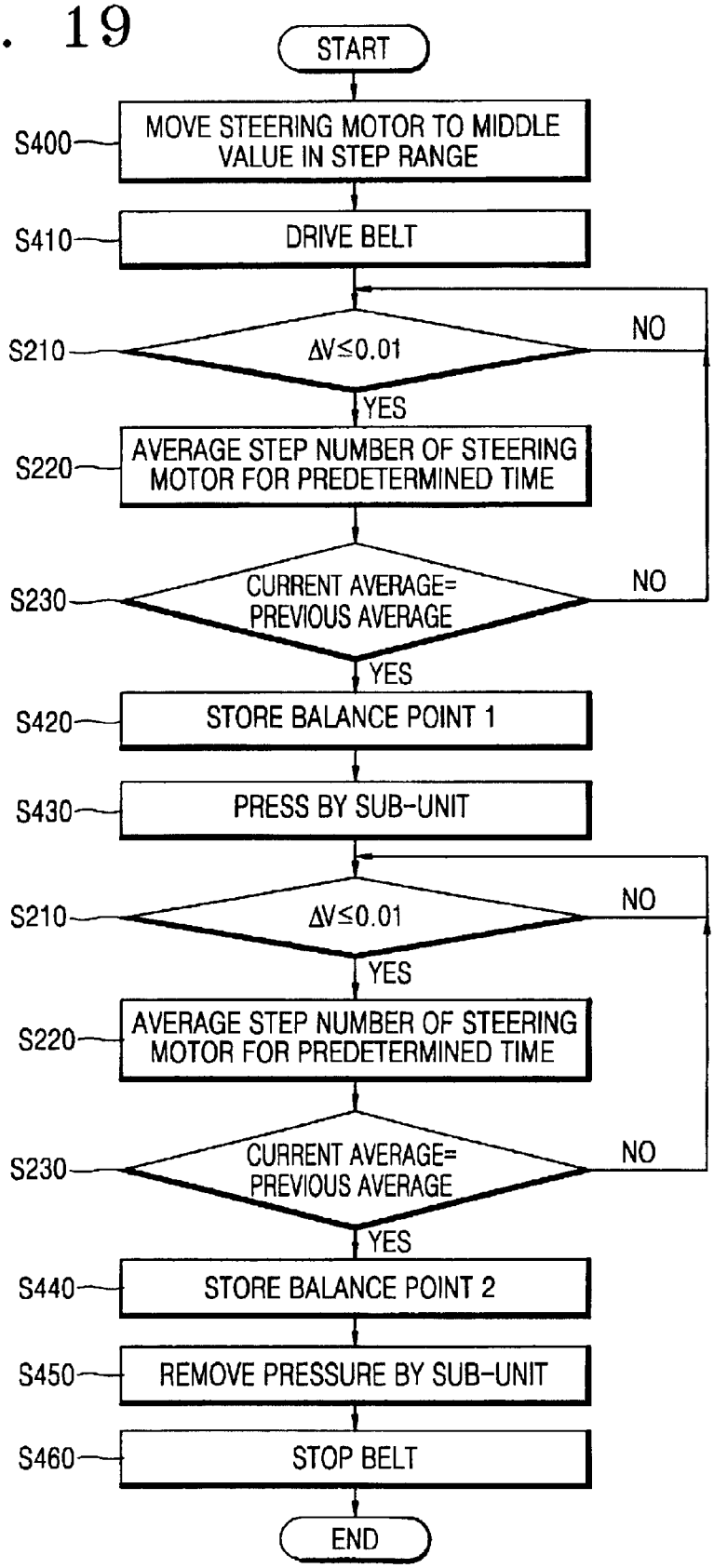
FIG. 19 is a flow chart showing a method of seeking the balance point, according to another aspect of the present invention.

The balance points 1 and 2 applied to the active steering method, according to another aspect of the present invention, are sought by the process as shown in FIG. 19. The process of seeking the balance points 1 and 2 may be performed whenever the belt 30 is first installed in the belt system, the belt 30 is replaced or the balance point changes, or the condition of pressure by the sub-unit changes.

Referring to FIG. 19, at operation S400, the steering motor controller 61 drives the steering motor 65 according to the control of the main controller 70 to move the steering roller 33 to a position corresponding to a middle value in a range of step of the steering motor 65. At operation S410, the belt drive motor 45 circulates the belt 30 in the proceeding direction. After seeking the balance point 1 at which there is no affect by the sub-unit, at operation S420, data on the balance point 1 is stored in the memory 75.

At operation S430, the balance point 2 is sought in the state in which the sub-unit applies pressure and, at operation S440, data on the balance point 2 is stored in the memory 75. The process of seeking the balance point 2 and storing the data thereof in the memory 75 can be repeated as many times as the number of the balance points changed by the operation of the sub-unit. After seeking and storing the balance point 2, the sub-unit is separated from the belt 30 and the belt 30 is stopped. Thus, the process of seeking the balance point is terminated.

Here, because operations S210, S220, and S230 to seek the balance points 1 and 2 are the same as those described with reference to FIG. 13, the operations are indicated by the same reference operation numbers of the previous aspect of the present invention and a detailed description thereof will be omitted.

As described, the active steering system, according to an aspect of the present invention, having the additional light source 51 can be applied to various kinds of belt systems, unlike the conventional registration system which can be applied only to a structure in which a laser beam emitted from a scanner is used as a light source and a photoreceptor belt is used. That is, the active steering technology, according to an aspect of the present invention, is adopted in all belt systems adopting at least one belt and can be applied to steering of a predetermined belt.

For example, the active steering system, according to an aspect of the present invention, as shown in FIG. 4, can be applied to the image forming apparatus to control the position of the photoreceptor belt in a main scanning direction. Also, the active steering system of an aspect of the present invention can be applied for the belt steering of a transfer belt, a drying belt, a fusing belt, a conveyance belt, and/or an oil supply apparatus or a cleaning apparatus of a fusing apparatus using a belt. Here, because the structure of the electrophotographic image forming apparatus adopting at least one of the transfer belt, the drying belt, the fusing belt, and the return belt is well known, and because the process of controlling the position of the belt 30 in the widthwise direction using the active steering system according to an aspect of the present invention is substantially the same as that of the previous description, the description and drawing of the steering process is omitted.

As described above, the active steering system, according to an aspect of the present invention, can be applied not only to an electrophotographic image forming apparatus such as printers, photocopiers, and facsimiles, but also to other various fields.

According to an aspect of the present invention, the belt is steered based on the balance point at which the belt is driven most stably to minimize the amount of weaving of the belt. Thus, when the present invention is applied to the image forming apparatus, a stable image output can be obtained without the additional registration correction circuit.

Also, according to an aspect of the present invention, because the belt is steered by changing the balance point according to the operational situation of at least one sub-unit affecting the balance point, the belt can be steered so that weaving of the belt is hardly generated during which the sub-unit applies or removes pressure to the belt.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. An active steering system, comprising:

a drive source;

a steering roller adjusting a belt in a widthwise direction, which is rotated by the drive source;

a steering motor driving the steering roller;

a steering controller controlling the steering motor;

a belt edge sensor detecting a belt edge signal according to a position of the belt in the widthwise direction; and a main controller controlling at least one of the drive source and the steering controller where the belt is rotated based on a balance point at which an amount of change of a step number of the steering motor is less than or equal to a predetermined value.

2. The active steering system as claimed in claim 1, wherein the belt edge sensor comprises:

a light source; and a photodetector provided across an edge of one side of the belt where an amount of a light emitted from the light source changes according to the position of the belt in the widthwise direction.

3. The active steering system as claimed in claim 1, wherein a process of seeking a balance point is performed when the belt is newly installed or replaced, or when the balance point is changed.

4. The active steering system as claimed in claim 3, wherein, when an average of step numbers of the steering motor for a predetermined time does not change within a predetermined range of allowance, a position corresponding to the average of the step numbers is set as the balance point.

5. The active steering system as claimed in claim 1, wherein, when an average of step numbers of the steering motor for a predetermined time does not change within a predetermined range of allowance, a position corresponding to the average of the step numbers is set as the balance point.

6. The active steering system as claimed in claim 4, wherein the predetermined time is a period of time the belt rotates one time.

7. The active steering system as claimed in claim 5, wherein the predetermined time is a period of time the belt rotates one time.

8. The active steering system as claimed in claim 2, wherein, while the belt is rotated with respect to the balance point, the belt is controlled where the edge is located at a center of the photodetector.

9. The active steering system as claimed in claim 2, wherein the light source comprises at least one light emitting diode.

10. The active steering system as claimed in claim 1, further comprising:

a memory storing data of the balance point.

11. The active steering system as claimed in claim 10, wherein the balance point changes according to an operation of at least one sub-unit affecting the balance point, where the at least one sub-unit is installed in a predetermined apparatus to which the active steering system is applied, and is measured in advance and stored in the memory, and the belt is steered according to the balance point fit to the operation of the sub-unit.

12. The active steering system as claimed in claim 11, wherein the predetermined apparatus is an image forming apparatus.

13. The active steering system as claimed in claim 11, wherein the belt is one of a photoreceptor belt, a transfer belt, a drying belt, a fusing belt, and a conveyance belt.

14. The active steering system as claimed in claim 11, wherein the steering motor is driven at a predetermined step interval.

15. The active steering system as claimed in claim 11, wherein the steering motor is driven at a larger step interval as the belt is located far away from a reference position with respect to the balance point, and at a smaller step interval as the belt is located close to the reference position.

16. The active steering system as claimed in claim 15, wherein the steering motor is driven at a step interval at which a relationship between the belt edge signal and the step number of the steering motor satisfies a quadratic function.

17. The active steering system as claimed in claim 1, wherein the active steering system is applied to an image forming apparatus.

18. The active steering system as claimed in claim 17, wherein the belt is one of a photoreceptor belt, a transfer belt, a drying belt, a fusing belt, and a conveyance belt.

19. The active steering system as claimed in claim 1, wherein the steering motor is driven at a predetermined step interval.

20. The active steering system as claimed in claim 1, wherein the steering motor is driven at a larger step interval as the belt is located far away from a reference position with respect to the balance point, and at a smaller step interval as the belt is located close to the reference position.

21. The active steering system as claimed in claim 20, wherein the steering motor is driven at a step interval at which a relationship between the belt edge signal and the step number of the steering motor satisfies a quadratic function.

22. A method of actively steering a belt in an active steering system comprising a drive source, a steering roller to adjust a belt in a widthwise direction which is rotated by the drive source, a steering motor to drive the steering roller, a steering controller to control the steering motor, a belt edge sensor to detect a belt edge signal according to a position of the belt in the widthwise direction, and a main controller to control at least one of the drive source and the steering controller where the belt is rotated based on a balance point at which an amount of change of at least one value of the belt edge signal and a step number of the steering motor is less than or equal to a predetermined value, the method comprising:

according to the control of the main controller, driving the steering motor to move the steering roller to the balance point at which the amount of change in the at least one value of the belt edge signal and the step number of the steering motor is less than or equal to the predetermined value, and driving the drive source to rotate the belt in a proceeding direction;

comparing the belt edge signal detected and a reference belt edge signal detected when the steering roller is located at the balance point; and when the belt edge signal is different from the reference belt edge signal, determining the step number of the steering motor changing from a reference step number with respect to the balance point, which corresponds to a degree of the belt edge signal deviating from the reference belt edge signal, and adjusting the position of the belt in the widthwise direction by moving the steering motor to the step number, wherein the position of the belt in the widthwise direction is controlled by repeating the comparing of the belt edge signal and the determining of the step number of the steering motor during the rotation of the belt.

23. The method as claimed in claim 22, further comprising:

providing across at least one side edge of the belt where an amount of change of a light received, which is emitted from a light source, changes according to the position of the belt in the widthwise direction, and, when the steering roller is located at the balance point, the edge of the belt is controlled to be located at a center of a photodetector.

24. The method as claimed in claim 22, further comprising:

seeking the balance point when the belt is newly installed or replaced, or when the balance point is changed.

25. The method as claimed in claim 24, wherein, when an average of the step numbers of the steering motor for a predetermined time is the same as an average previously obtained within a predetermined range of allowance, the method further comprising:

setting a position of the steering roller corresponding to the average of the step numbers as a balance point.

26. The method as claimed in claim 25, wherein the predetermined time is a period of time the belt rotates one time.

27. The method as claimed in claim 22, further comprising:

changing the balance point according to an operation of at least one sub-unit affecting the balance point, where the at least one sub-unit is installed in a predetermined apparatus to which an active steering system is applied and is measured in advance and stored in a memory; and steering the belt with respect to the balance point fit to the operation of the sub-unit.

28. The method as claimed in claim 27, further comprising:

driving the steering motor at a predetermined step interval.

29. The method as claimed in claim 27, further comprising:

driving the steering motor at a larger step interval as the belt is located far away from a reference position with respect to the balance point, and at a smaller step interval as the belt is located close to the reference position.

30. The method as claimed in claim 29, further comprising:

driving the steering motor at a step interval at which a relationship between the belt edge signal and the step number of the steering motor satisfies a quadratic function.

31. The method as claimed in claim 30, wherein the seeking of the balance point occurs when the belt is newly installed or replaced, or when the balance point is changed.

32. A method of seeking a balance point at which a belt is driven stably to steer the belt using an active steering system, which comprises a drive source, a steering roller to adjust a belt in a widthwise direction which is rotated by the drive source, a steering motor to drive the steering roller, a steering controller to control the steering motor, a belt edge sensor to detect a belt edge signal according to a position of the belt in the widthwise direction, and a main controller to control at least one of the drive source and the steering controller where the belt is rotated based on a balance point at which an amount of change of at least one value of the belt edge signal and a step number of the steering motor is less than or equal to a predetermined value, the method comprising:

when the amount of the change of the at least one value of the belt edge signal and the step number of the steering motor is less than or equal to a value, obtaining an average by averaging the step numbers of the steering motor for a predetermined time;

comparing the average of the step numbers and an average of the step numbers previously obtained; and when the average of the step numbers is the same as the average previously obtained of the step numbers within a predetermined range of allowance, determining a position of the steering roller corresponding to the average of the step numbers as the balance point.

33. The method as claimed in claim 32, wherein the seeking of the balance point is performed in a case in which the steering roller is moved to a position corresponding to a middle value of a step range of the steering motor or the step number corresponding to a previous balance point by driving the steering motor.

34. The method as claimed in claim 32, wherein the seeking of the balance point is performed when the belt is newly installed or replaced, or when the balance point is changed.

35. The method as claimed in claim 32, further comprising:

storing the sought balance point.

36. The method as claimed in claim 35, wherein the driving of the steering motor, the comparing of the belt edge detected, and the determining of the step number are repeated by changing an operational state of at least one sub-unit to seek a first balance point when there is no effect by an operation of the sub-unit and a second balance point changed during the operation of the sub-unit, where an optimal belt steering can be performed even when the balance point is changed according to the operation of the sub-unit affecting the balance point, which is installed in an apparatus to which the active steering system is applied.

37. The method as claimed in claim 36, wherein the seeking of the second balance point is repeated as many times as a number of balance points changed according to the operation of the sub-unit.

38. A method of an active steering system, comprising:

minimizing an amount of weaving of a belt by steering the belt based on a balance point at which the belt is driven most stably where no additional registration correction is needed when applied to an image forming apparatus; and steering the belt by changing the balance point according to an operation of at least one sub-unit affecting the balance point.

39. The method as claimed in claim 38, further comprising:

adjusting the belt in a widthwise direction, which is rotated by a drive source;

detecting a belt edge signal according to a position of the belt in the widthwise direction; and rotating the belt based on the balance point at which an amount of change of at least one value of the belt edge signal and a step number of a steering motor is less than or equal to a predetermined value.

40. The method as claimed in claim 38, wherein the at least one sub-unit is installed in a predetermined apparatus to which the active steering system is applied.

41. An active steering system, comprising:

a drive source;

a steering roller adjusting a belt in a widthwise direction, which is rotated by the drive source;

a steering motor driving the steering roller;

a steering controller controlling the steering motor;

a belt edge sensor detecting a belt edge signal according to a position of the belt in the widthwise direction; and a main controller controlling at least one of the drive source and the steering controller where the belt is rotated based on a balance point at which an amount of change of the belt code signal and a step number of the steering motor is less than or equal to a predetermined value.

* * * * *

UNITED STATES PATENT AND TRADEMARK OFFICE

CERTIFICATE OF CORRECTION

PATENT NO. : 6,804,486 B2
APPLICATION NO. : 10/314417
DATED : October 12, 2004
INVENTOR(S) : Beom-ro Lee et al.

It is certified that error appears in the above-identified patent and that said Letters Patent is hereby corrected as shown below:

Column 22, line 43, change “code” to --edge--.

Signed and Sealed this

Twenty-first Day of November, 2006

JON W. DUDAS
*Director of the United States Patent and Trademark Office*